US011263970B2

(12) United States Patent
Xuan et al.

(10) Patent No.: US 11,263,970 B2
(45) Date of Patent: Mar. 1, 2022

(54) PIXEL DRIVING CIRCUIT, PIXEL DRIVING METHOD, DISPLAY PANEL AND DISPLAY DEVICE

(71) Applicant: BOE TECHNOLOGY GROUP CO., LTD., Beijing (CN)

(72) Inventors: Minghua Xuan, Beijing (CN); Qi Qi, Beijing (CN); Jing Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/052,147

(22) PCT Filed: Nov. 1, 2019

(86) PCT No.: PCT/CN2019/115163

§ 371 (c)(1),
(2) Date: Oct. 30, 2020

(87) PCT Pub. No.: WO2021/042480

PCT Pub. Date: Mar. 11, 2021

(65) Prior Publication Data

US 2021/0241695 A1 Aug. 5, 2021

(51) Int. Cl.

*G09G 3/3258* (2016.01)
*G09G 3/3275* (2016.01)
*G09G 3/3266* (2016.01)

(52) U.S. Cl.

CPC ..... *G09G 3/3258* (2013.01); *G09G 3/3266* (2013.01); *G09G 3/3275* (2013.01); *G09G 2300/0426* (2013.01)

(58) Field of Classification Search

CPC ..... G09G 3/32; G09G 3/3258; G09G 3/3266; G09G 3/3275; G09G 3/3208

See application file for complete search history.

(56) References Cited

U.S. PATENT DOCUMENTS

2009/0121981 A1 5/2009 Yoo et al.
2016/0035276 A1 2/2016 Yin et al.
(Continued)

FOREIGN PATENT DOCUMENTS

CN 103700342 A 4/2014
CN 104821150 A 8/2015
(Continued)

OTHER PUBLICATIONS

International Search Report and Written Opinion dated May 28, 2020 in International Patent Application No. PCT/CN2019/104235, 18 pages.
(Continued)

*Primary Examiner* — Sardis F Azongha
(74) *Attorney, Agent, or Firm* — Procopio, Cory, Hargreaves & Savitch LLP

(57) ABSTRACT

A pixel driving circuit includes a driving signal control sub-circuit and a driving duration control sub-circuit. The driving signal control sub-circuit is configured to provide a driving signal to the driving duration control sub-circuit under control of a first scanning signal transmitted via the first scanning signal terminal and an enable signal transmitted via the enable signal terminal. The driving signal is related to a first data signal and a first voltage signal. The driving duration control sub-circuit is configured to transmit the driving signal to the element to be driven under control of a second scanning signal transmitted via the second scanning signal terminal and the enable signal transmitted via the enable signal terminal. A duration for transmitting the driving signal to the element to be driven is related to a second data signal.

20 Claims, 11 Drawing Sheets

(56) References Cited

U.S. PATENT DOCUMENTS

| | | | |
|---|---|---|---|
| 2018/0130412 | A1 | 5/2018 | Zhang et al. |
| 2018/0261155 | A1 | 9/2018 | Ota |
| 2019/0236997 | A1 | 8/2019 | Han |

FOREIGN PATENT DOCUMENTS

| | | | | | |
|---|---|---|---|---|---|
| CN | 107068059 | A | | 8/2017 | |
| CN | 107909966 | A | | 4/2018 | |
| CN | 108389550 | A | | 8/2018 | |
| CN | 108538241 | A | | 9/2018 | |
| CN | 109920371 | A | | 6/2019 | |
| CN | 109979378 | A | | 7/2019 | |
| CN | 110010057 | A | | 7/2019 | |
| CN | 110021263 | A | | 7/2019 | |
| CN | 110085164 | A | | 8/2019 | |
| EP | 3816978 | A | * | 5/2021 | ..... G09G 3/32 |
| JP | 2004151587 | A | | 5/2004 | |
| WO | 2019109615 | A1 | | 6/2019 | |
| WO | 2020007024 | A1 | | 1/2020 | |

OTHER PUBLICATIONS

International Search Report and Written Opinion dated May 28, 2020 in International Patent Application No. PCT/CN2019/115163, 19 pages.

* cited by examiner

PIXEL DRIVING CIRCUIT, PIXEL DRIVING METHOD, DISPLAY PANEL AND DISPLAY DEVICE

CROSS-REFERENCE TO RELATED APPLICATIONS

This application is a national phase entry under 35 USC 371 of International Patent Application No. PCT/CN2019/115163 filed on Nov. 1, 2019, which claims priority to International Patent Application No. PCT/CN2019/104235, filed on Sep. 3, 2019, which are incorporated herein by reference in their entirety.

TECHNICAL FIELD

The present disclosure relates to the field of display technologies, and in particular, to a pixel driving circuit, a pixel driving method, a display panel and a display device.

BACKGROUND

In the field of display technologies, the application of a high-dynamic range (HDR) image technology in display devices can improve the image quality of the display image, and also put forward higher requirements on the color gamut and brightness of the display device. The micro light-emitting diode display device is more suitable for realizing the display of the HDR image due to its high brightness and wide color gamut.

SUMMARY

In a first aspect, a pixel driving circuit is provided. The pixel driving circuit includes a driving signal control sub-circuit, a driving duration control sub-circuit, a first scanning signal terminal, a first data signal terminal, a first voltage signal terminal, an enable signal terminal, a second scanning signal terminal, a second data signal terminal and an element to be driven. The driving signal control sub-circuit is electrically connected to the first scanning signal terminal, the first data signal terminal, the first voltage signal terminal, the enable signal terminal and the driving duration control sub-circuit, and is configured to provide a driving signal to the driving duration control sub-circuit under control of a first scanning signal transmitted via the first scanning signal terminal and an enable signal transmitted via the enable signal terminal. The driving signal is related to a first data signal received at the first data signal terminal and a first voltage signal received at the first voltage signal terminal. The driving duration control sub-circuit is electrically connected to the second scanning signal terminal, the second data signal terminal, the enable signal terminal and the element to be driven, and is configured to transmit the driving signal to the element to be driven under control of a second scanning signal transmitted via the second scanning signal terminal and the enable signal transmitted via the enable signal terminal. A duration for transmitting the driving signal to the element to be driven is related to a second data signal received at the second data signal terminal.

In some embodiments, the pixel driving circuit further includes a third voltage signal terminal. The driving signal control sub-circuit includes a first data writing unit, a first driving unit and a first control unit. The first data writing unit is electrically connected to the first scanning signal terminal, the first data signal terminal and the first driving unit, and is configured to write the first data signal received at the first data signal terminal into the first driving unit under the control of the first scanning signal transmitted via the first scanning signal terminal. The first control unit is electrically connected to the enable signal terminal, the first voltage signal terminal and the first driving unit, and is configured to input the first voltage signal received at the first voltage signal terminal to the first driving unit under the control of the enable signal transmitted via the enable signal terminal. The first driving unit is electrically connected to the third voltage signal terminal, and is configured to generate a driving signal according to the written first data signal, the input first voltage signal and a third voltage signal received at the third voltage signal terminal, and transmit the driving signal to the first control unit. The first control unit is electrically connected to the driving duration control sub-circuit, and is configured to transmit the driving signal to the driving duration control sub-circuit under the control of the enable signal transmitted via the enable signal terminal.

In some embodiments, the first data writing unit includes a first transistor and a second transistor. A control electrode of the first transistor is electrically connected to the first scanning signal terminal, a first electrode of the first transistor is electrically connected to the first data signal terminal, and a second electrode of the first transistor is electrically connected to the first driving unit. A control electrode of the second transistor is electrically connected to the first scanning signal terminal, and a first electrode and a second electrode of the second transistor are electrically connected to the first driving unit.

The first driving unit includes a first storage capacitor and a third transistor. A first end of the first storage capacitor is electrically connected to the first data writing unit and the first control unit, and a second end of the first storage capacitor is electrically connected to the first data writing unit. A control electrode of the third transistor is electrically connected to the second end of the first storage capacitor and the first data writing unit, a first electrode of the third transistor is electrically connected to the third voltage signal terminal, and a second electrode of the third transistor is electrically connected to the first data writing unit and the first control unit.

The first control unit includes a fourth transistor and a fifth transistor. A control electrode of the fourth transistor is electrically connected to the enable signal terminal, a first electrode of the fourth transistor is electrically connected to the first voltage signal terminal, and a second electrode of the fourth transistor is electrically connected to the first driving unit. A control electrode of the fifth transistor is electrically connected to the enable signal terminal, a first electrode of the fifth transistor is electrically connected to the first driving unit, and a second electrode of the fifth transistor is electrically connected to the driving duration control sub-circuit.

In some embodiments, the driving signal control sub-circuit further includes a first reset unit, a reset signal terminal and an initialization signal terminal. The first reset unit is electrically connected to the first voltage signal terminal, the reset signal terminal, the initialization signal terminal and the first driving unit, and is configured to reset a voltage of the first driving unit according to the first voltage signal received at the first voltage signal terminal and an initialization signal received at the initialization signal terminal under control of a reset signal transmitted via the reset signal terminal.

In some embodiments, the first reset unit includes a sixth transistor and a seventh transistor. A control electrode of the sixth transistor is electrically connected to the reset signal terminal, a first electrode of the sixth transistor is electrically connected to the first voltage signal terminal, and a second electrode of the sixth transistor is electrically connected to the first driving unit. A control electrode of the seventh transistor is electrically connected to the reset signal terminal, a first electrode of the seventh transistor is electrically connected to the initialization signal terminal, and a second electrode of the seventh transistor is electrically connected to the first driving unit.

In some embodiments, the driving signal control sub-circuit further includes a driving signal stabilization unit. The driving signal stabilization unit is electrically connected to the first driving unit, and is configured to stabilize the driving signal generated by the first driving unit.

In some embodiments, the driving signal stabilization unit includes a voltage stabilizing storage capacitor. In a case where the first driving unit includes the first storage capacitor and the third transistor, a first end of the voltage stabilizing storage capacitor is electrically connected to the first end of the first storage capacitor, and a second end of the voltage stabilizing storage capacitor is electrically connected to the second electrode of the third transistor; or, a first end of the voltage stabilizing storage capacitor is electrically connected to the second end of the first storage capacitor, and a second end of the voltage stabilizing storage capacitor is electrically connected to the second electrode of the third transistor.

In some embodiments, the pixel driving circuit further includes a third voltage signal terminal, a reset signal terminal and an initialization signal terminal; the driving signal control sub-circuit includes the first transistor, the second transistor, the third transistor, the fourth transistor, the fifth transistor, the sixth transistor, the seventh transistor, the first storage capacitor and the voltage stabilizing storage capacitor. The control electrode of the first transistor is electrically connected to the first scanning signal terminal, the first electrode of the first transistor is electrically connected to the first data signal terminal, and the second electrode of the first transistor is electrically connected to the first end of the first storage capacitor. The control electrode of the second transistor is electrically connected to the first scanning signal terminal, the first electrode of the second transistor is electrically connected to the second electrode of the third transistor, and the second electrode of the second transistor is electrically connected to the second end of the first storage capacitor and the control electrode of the third transistor.

The control electrode of the third transistor is also electrically connected to the second end of the first storage capacitor, the first electrode of the third transistor is electrically connected to the third voltage signal terminal, and the second electrode of the third transistor is also electrically connected to the first electrode of the fifth transistor. The control electrode of the fourth transistor is electrically connected to the enable signal terminal, the first electrode of the fourth transistor is electrically connected to the first voltage signal terminal, and the second electrode of the fourth transistor is electrically connected to the first end of the first storage capacitor.

The control electrode of the fifth transistor is electrically connected to the enable signal terminal, and the second electrode of the fifth transistor is electrically connected to the driving duration control sub-circuit. The control electrode of the sixth transistor is electrically connected to the reset signal terminal, the first electrode of the sixth transistor is electrically connected to the first voltage signal terminal, and the second electrode of the sixth transistor is electrically connected to the first end of the first storage capacitor. The control electrode of the seventh transistor is electrically connected to the reset signal terminal, the first electrode of the seventh transistor is electrically connected to the initialization signal terminal, and the second electrode of the seventh transistor is electrically connected to the second end of the first storage capacitor and the control electrode of the third transistor.

The first end of the voltage stabilizing storage capacitor is electrically connected to the first end of the first storage capacitor, and the second end of the voltage stabilizing storage capacitor is electrically connected to the second electrode of the third transistor; or, the first end of the voltage stabilizing storage capacitor is electrically connected to the second end of the first storage capacitor, and the second end of the voltage stabilizing storage capacitor is electrically connected to the second electrode of the third transistor.

In some embodiments, the first transistor, the second transistor, the third transistor, the fourth transistor, the fifth transistor, the sixth transistor, and the seventh transistor are all P-type transistors or N-type transistors.

In some embodiments, the driving duration control sub-circuit includes a second data writing unit, a second control unit and a second driving unit. The second data writing unit is electrically connected to the second scanning signal terminal, the second data signal terminal and the second driving unit, and is configured to write a second data signal having a given working potential received at the second data signal terminal into the second driving unit under the control of the second scanning signal transmitted via the second scanning signal terminal.

The second control unit is electrically connected to the enable signal terminal, the second data signal terminal and the second driving unit, and is configured to transmit a second data signal having a potential changing within a given range received at the second data signal terminal to the second driving unit under the control of the enable signal transmitted via the enable signal terminal.

The second driving unit is also electrically connected to the driving signal control sub-circuit, and is configured to transmit the driving signal to the second control unit and control a duration for transmitting the driving signal to the second control unit according to the second data signal having the given working potential and the second data signal having the potential changing within the given range. The second control unit is also electrically connected to the element to be driven, and is also configured to transmit the driving signal to the element to be driven.

In some embodiments, the pixel driving circuit further includes a reset signal terminal and an initialization signal terminal. The second data writing unit includes an eighth transistor. A control electrode of the eighth transistor is electrically connected to the second scanning signal terminal, a first electrode of the eighth transistor is electrically connected to the second data signal terminal, and a second electrode of the eighth transistor is electrically connected to the second driving unit.

The second control unit includes a ninth transistor and a tenth transistor. A control electrode of the ninth transistor is electrically connected to the enable signal terminal, a first electrode of the ninth transistor is electrically connected to the second data signal terminal, and a second electrode of the ninth transistor is electrically connected to the second driving unit. A control electrode of the tenth transistor is electrically connected to the enable signal terminal, a first electrode of the tenth transistor is electrically connected to the second driving unit, and a second electrode of the tenth transistor is electrically connected to the element to be driven.

The second driving unit includes a second storage capacitor and an eleventh transistor. A first end of the second storage capacitor is electrically connected to the second data writing unit and the second control unit. A control electrode of the eleventh transistor is electrically connected to a second end of the second storage capacitor, a first electrode of the eleventh transistor is electrically connected to the driving signal control sub-circuit, and a second electrode of the eleventh transistor is electrically connected to the second control unit.

In some embodiments, the driving duration control sub-circuit further includes a second reset unit, a reset signal terminal and an initialization signal terminal. The second reset unit is electrically connected to the reset signal terminal, the initialization signal terminal and the second driving unit, and is configured to reset a voltage of the second driving unit according to the initialization signal received at the initialization signal terminal under the control of the reset signal transmitted via the reset signal terminal.

In some embodiments, the second reset unit includes a twelfth transistor and a thirteenth transistor. A control electrode of the twelfth transistor is electrically connected to the reset signal terminal, a first electrode of the twelfth transistor is electrically connected to the initialization signal terminal, and a second electrode of the twelfth transistor is electrically connected to the second driving unit. A control electrode of the thirteenth transistor is electrically connected to the reset signal terminal, and a first electrode and a second electrode of the thirteenth transistor are electrically connected to the second driving unit.

In some embodiments, the driving duration control sub-circuit includes the eighth transistor, the ninth transistor, the tenth transistor, the eleventh transistor, the twelfth transistor, the thirteenth transistor and the second storage capacitor. The control electrode of the eighth transistor is electrically connected to the second scanning signal terminal, the first electrode of the eighth transistor is electrically connected to the second data signal terminal, and the second electrode of the eighth transistor is electrically connected to the first end of the second storage capacitor. The control electrode of the ninth transistor is electrically connected to the enable signal terminal, the first electrode of the ninth transistor is electrically connected to the second data signal terminal, and the second electrode of the ninth transistor is electrically connected to the first end of the second storage capacitor.

The control electrode of the tenth transistor is electrically connected to the enable signal terminal, the first electrode of the tenth transistor is electrically connected to the second electrode of the eleventh transistor, and the second electrode of the tenth transistor is electrically connected to the element to be driven. The control electrode of the eleventh transistor is electrically connected to the second end of the second storage capacitor, the first electrode of the eleventh transistor is electrically connected to the driving signal control sub-circuit and the second electrode of the twelfth transistor, and the second electrode of the eleventh transistor is also electrically connected to the first electrode of the thirteenth transistor.

The control electrode of the twelfth transistors is electrically connected to the reset signal terminal, and the first electrode of the twelfth transistor is electrically connected to the initialization signal terminal. The control electrode of the thirteenth transistor is electrically connected to the reset signal terminal, and the second electrode of the thirteenth transistor is electrically connected to the second end of the second storage capacitor and the control electrode of the eleventh transistor.

In some embodiments, the eighth transistor, the ninth transistor, the tenth transistor, the eleventh transistor, the twelfth transistor and the thirteenth transistor are all P-type transistors or all N-type transistors.

In a second aspect, a pixel driving method is provided. The pixel driving method is applied to the pixel driving circuit described in any embodiment of the first aspect. The pixel driving method includes a frame period including a scanning stage and a working stage. The scanning stage includes a plurality of row scanning periods. Each of the plurality of row scanning periods includes: writing the first data signal into the driving signal control sub-circuit under the control of the first scanning signal transmitted via the first scanning signal terminal; and writing a second data signal having a given working potential into the driving duration control sub-circuit under the control of the second scanning signal transmitted via the second scanning signal terminal.

The working stage includes: providing, by the driving signal control sub-circuit, the driving signal to the driving duration control sub-circuit under the control of the enable signal transmitted via the enable signal terminal; receiving, by the driving duration control sub-circuit, a second data signal having a potential changing within a given range under the control of the enable signal transmitted via the enable signal terminal; and transmitting, by the driving duration control sub-circuit, the driving signal to an element to be driven under the control of the enable signal transmitted via the enable signal terminal. The driving signal is related to the first data signal and the first voltage signal provided via the first voltage signal terminal. The duration for transmitting the driving signal to the element to be driven is related to the second data signal having the given working potential and the second data signal having the potential changing within the given range.

In some embodiments, an absolute value of the given working potential is related to a working duration of a corresponding element to be driven.

In some embodiments, values of two ends of the given range are a non-working potential and a reference working potential of the second data signal respectively. An absolute value of the reference working potential is greater than or equal to a maximum value of absolute values of all given working potentials of the second data signal; and the given working potential is within the given range.

In a third aspect, a display panel is provided. The display panel includes the pixel driving circuit according to any embodiment of the first aspect.

In some embodiments, the display panel includes a plurality of sub-pixels. Each sub-pixel corresponds to one pixel driving circuit, and the plurality of sub-pixels are arranged in an array of multiple rows and multiple columns. The display panel further includes a plurality of first scanning signal lines, a plurality of first data signal lines, a plurality of second scanning signal lines, and a plurality of second data signal lines. Pixel driving circuits corresponding to sub-pixels in a same row are electrically connected to a same first scanning signal line and a same second scanning signal line. Pixel driving circuits corresponding to sub-pixels in a same column are electrically connected to a same first data signal line and a same second data signal line.

In some embodiments, the display panel further includes a base substrate on which the pixel driving circuit is disposed, and the base substrate is a glass substrate.

In a fourth aspect, a display device is provided. The display device includes the display panel as described in the third aspect.

BRIEF DESCRIPTION OF THE DRAWINGS

In order to describe technical solutions in some embodiments of the present disclosure more clearly, the accompanying drawings to be used in some embodiments of the present disclosure will be introduced briefly. However, the accompanying drawings to be described below are merely some embodiments of the present disclosure, and a person of ordinary skill in the art can obtain other drawings according to these drawings.

DETAILED DESCRIPTION

The technical solutions in embodiments of the present disclosure will be described clearly and completely in combination with the accompanying drawings in the embodiments of the present disclosure. Obviously, the described embodiments are merely some but not all of the embodiments of the present disclosure. All other embodiments made on the basis of the embodiments of the present disclosure by a person of ordinary skill in the art shall be included in the protection scope of the present disclosure.

In the field of display technologies, a micro light-emitting diode (Micro LED) display device is high in brightness and wide in color gamut, which can meet the requirements on the brightness and color gamut of a display device in which a high-dynamic range (HDR) image technology is applied thereto, and is more suitable for realizing HDR display.

In the related art, a pixel driving circuit of the Micro LED display device is typically controlled by a driving current. A luminous intensity of a micro LED is controlled by controlling a magnitude of a driving current input to the micro LED, thereby realizing the display of different gray scales. For example, in a case where a display of a low gray scale is achieved, a small driving current is provided and the brightness of the micro LED is reduced; and in a case where a display of a high gray scale is achieved, a large driving current is provided and the brightness of the micro LED is improved.

Inventors of the present disclosure have discovered through research that, the micro LED has the characteristics of high luminous efficiency at a high current density, and low luminous efficiency and a shift of a principal peak at a low current density. Specific performances are that: in a case where the driving current input to the micro LED reaches a certain value, the luminous efficiency of the micro LED reaches the highest; and in a case where the driving current fails to reach the certain value, the luminous efficiency of the micro LED is in a climbing stage. That is, as the driving current provided increases, the luminous intensity of the micro LED gradually increases. Meanwhile, the luminous efficiency gradually increases, and when the luminous efficiency increases to a certain extent, the luminous efficiency of the micro LED tends to be stable.

In a case where a driving manner of controlling the luminous intensity of the micro LED by controlling the magnitude of the driving current in the related art is adopted, the driving current input to the micro LED is low when the display of a low gray scale is realized. In this way, the micro LED is at a low current density, resulting in low luminous efficiency and high energy consumption of the micro LED, and energy consumption of the display device is high when displaying, causing energy loss.

Figure 1:
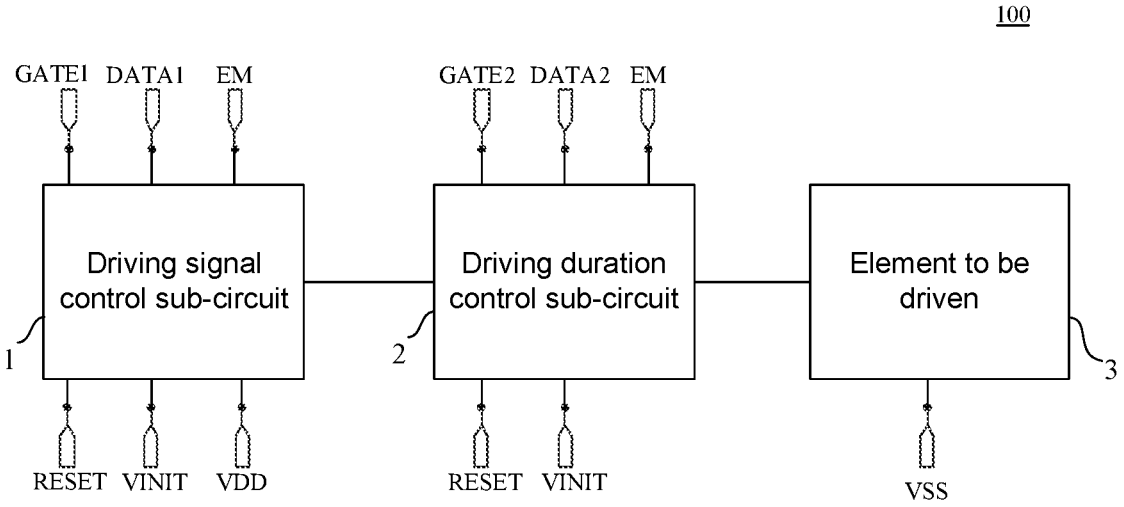
FIG. 1 is a schematic diagram showing a structure of a pixel driving circuit, according to some embodiments of the present disclosure.

Some embodiments of the present disclosure provide a pixel driving circuit 100. As shown in FIG. 1, the pixel driving circuit 100 includes a driving signal control sub-circuit 1 and a driving duration control sub-circuit 2.

The driving signal control sub-circuit 1 is electrically connected to a first scanning signal terminal GATE1, a first data signal terminal DATA1, a first voltage signal terminal VDD, an enable signal terminal EM and the driving duration control sub-circuit 2. The first scanning signal terminal GATE1 is configured to receive a first scanning signal Gate1, and input the first scanning signal Gate1 to the driving signal control sub-circuit 1; the first data signal terminal DATA1 is configured to receive a first data signal Data1, and input the first data signal Data1 to the driving signal control sub-circuit 1; the first voltage signal terminal VDD is configured to receive a first voltage signal Vdd, and input the first voltage signal Vdd to the driving signal control sub-circuit 1; and the enable signal terminal EM is configured to receive an enable signal Em, and input the enable signal Em to the driving signal control sub-circuit 1.

The driving signal control sub-circuit 1 is configured to provide a driving signal to the driving duration control sub-circuit 2 under the control of the first scanning signal Gate1 transmitted via the first scanning signal terminal GATE1 and the enable signal Em transmitted via the enable signal terminal EM. The driving signal is related to the first data signal Data1 received at the first data signal terminal DATA1 and the first voltage signal Vdd received at the first voltage signal terminal VDD.

The driving duration control sub-circuit 2 is also electrically connected to a second scanning signal terminal GATE2, a second data signal terminal DATA2, the enable signal terminal EM and an element 3 to be driven. The second scanning signal terminal GATE2 is configured to receive a second scanning signal Gate2, and input the second scanning signal Gate2 to the driving duration control sub-circuit 2; the second data signal terminal DATA2 is configured to receive a second data signal Data2, and input the second data signal Data2 to the driving duration control sub-circuit 2; and the enable signal terminal EM is configured to receive the enable signal Em, and input the enable signal Em to the driving duration control sub-circuit 2.

The driving duration control sub-circuit 2 is configured to transmit the driving signal to the element 3 to be driven under the control of the second scanning signal Gate2 transmitted via the second scanning signal terminal GATE2 and the enable signal Em transmitted via the enable signal terminal EM. A duration for transmitting the driving signal to the element 3 to be driven is related to the second data signal Data2 received at the second data signal terminal DATA2.

As a result, the pixel driving circuit 100 includes the driving signal control sub-circuit 1 and the driving duration control sub-circuit 2. The driving signal control sub-circuit 1 is configured to provide the driving signal to the driving duration control sub-circuit 2, and a magnitude of the driving signal is related to the first data signal Data1 and the first voltage signal Vdd. The driving duration control sub-circuit 2 is configured to transmit the driving signal to the element 3 to be driven, and a duration for transmitting the driving signal to the element 3 to be driven is related to the second data signal Data2. In a case where the driving signal is transmitted to the element 3 to be driven, the element 3 to be driven works, that is, a working duration of the element 3 to be driven is related to the second data signal Data2.

In this way, under joint action of the driving signal control sub-circuit 1 and the driving duration control sub-circuit 2, the magnitude of the driving current and the working duration of the element 3 to be driven are controlled by controlling the magnitude of the driving signal and the duration for transmitting the driving signal to the element 3 to be driven. As a result, the control of the element 3 to be driven is realized.

In some embodiments, the element 3 to be driven is a light-emitting device, such as a micro LED. The driving signal control sub-circuit 1 controls the magnitude of the driving current transmitted to the light-emitting device by controlling the magnitude of the driving signal. The driving duration control sub-circuit 2 controls the working duration of the light-emitting device by controlling the duration for transmitting the driving signal to the light-emitting device. In this way, when different gray scales are displayed, a luminous intensity of the light-emitting device may be changed by controlling the magnitude of the driving current of the light-emitting device and the light-emitting duration of the light-emitting device, and thereby the display of corresponding gray scales may be realized.

The inventors of the present disclosure have discovered through research that, in a case where the driving current is large, the light-emitting device (such as the micro LED) is at a high current density, which has high luminous efficiency and low energy consumption. In a case where a display of a high gray scale is achieved by using the pixel driving circuit 100, the luminous intensity of the light-emitting device is improved by increasing the driving current input to the light-emitting device; and in a case where a display of a low gray scale is achieved, the luminous intensity of the light-emitting device is reduced by shortening the working duration of the light-emitting device without a need to reduce the driving current input to the light-emitting device. In this way, the driving current transmitted to the light-emitting device is always large, and the light-emitting device is always at a high current density, and has high luminous efficiency. As a result, effects of reducing power consumption and saving costs are achieved.

In some embodiments, in a case where the element 3 to be driven is a micro LED, the first data signal Data1 provided via the first data signal terminal DATA1 may be a fixed high-level signal that enables the element 3 to be driven to have high luminous efficiency. In this case, the pixel driving circuit 100 controls the gray scale mainly through the driving signal control sub-circuit 1. In some other embodiments, a potential of the first data signal Data1 may be changed within a certain voltage interval range, and the first data signal Data1 within the voltage interval range is able to ensure that the element 3 to be driven has high luminous efficiency. In this case, the pixel driving circuit 100 controls the gray scale through the joint action of the driving signal control sub-circuit 1 and the driving duration control sub-circuit 2. Through this arrangement, in the above two cases, the element 3 to be driven may have high luminous efficiency, so that the power consumption thereof may be reduced.

Figure 2A:
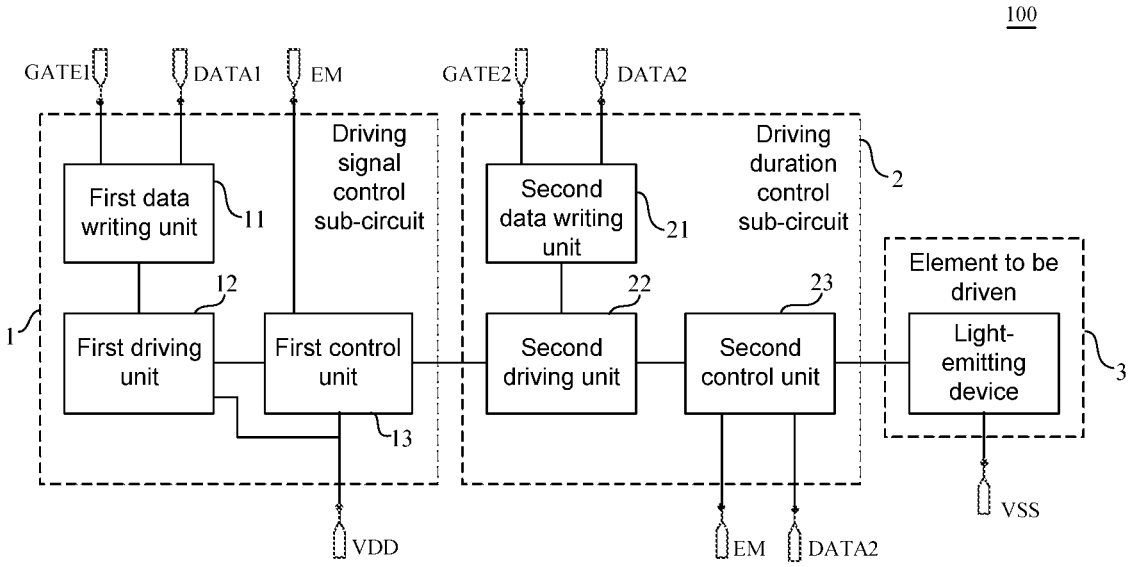
FIG. 2A is a schematic diagram showing another structure of a pixel driving circuit, according to some embodiments of the present disclosure.
Figure 3A:
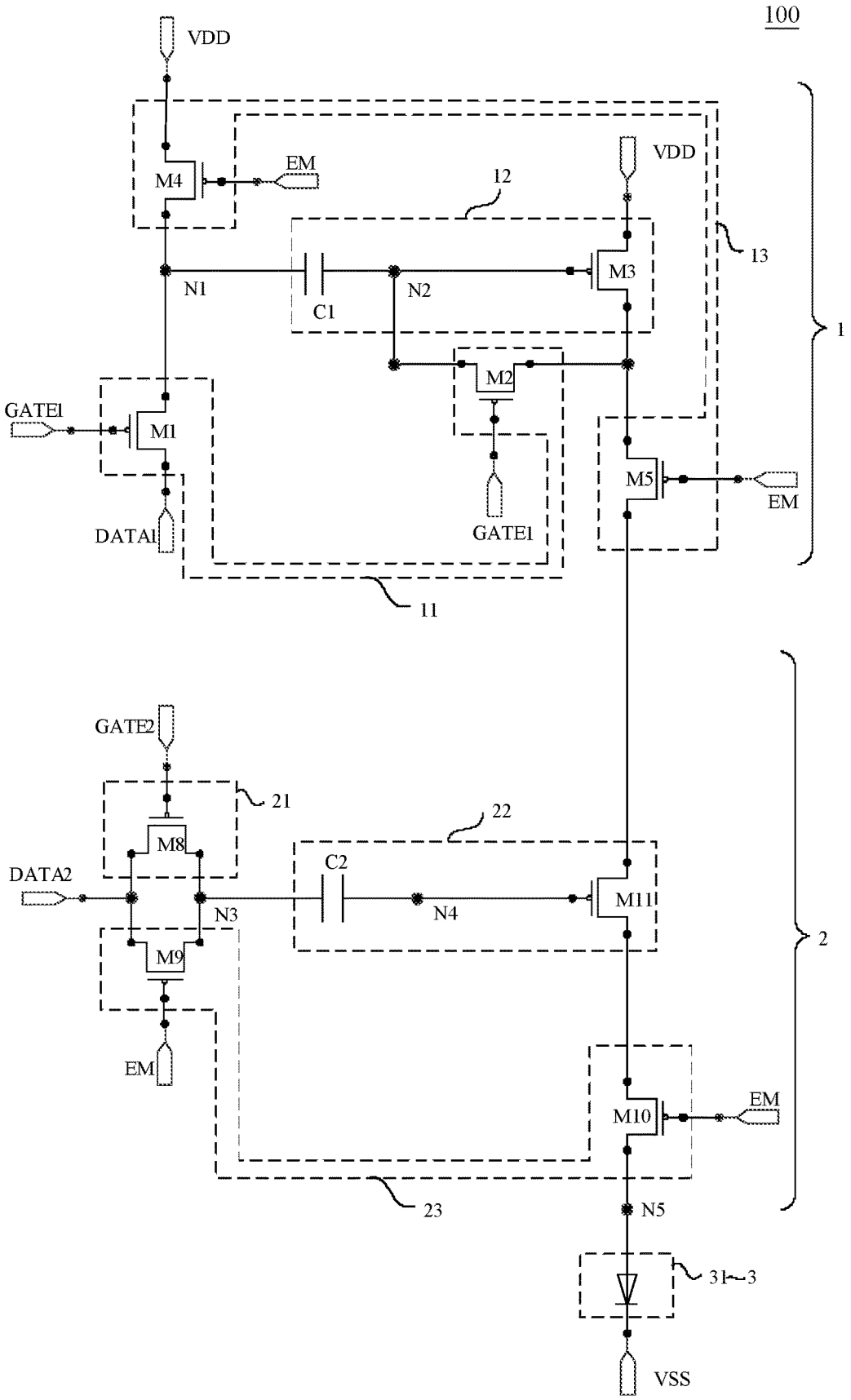
FIG. 3A is a schematic diagram showing yet another structure of a pixel driving circuit, according to some embodiments of the present disclosure.

In some embodiments, as shown in FIGS. 2A and 3A, the driving signal control sub-circuit 1 includes a first data writing unit 11, a first driving unit 12 and a first control unit 13.

The first data writing unit 11 is electrically connected to the first scanning signal terminal GATE1, the first data signal terminal DATA1 and the first driving unit 12, and is configured to write the first data signal Data1 received at the first data signal terminal DATA1 into the first driving unit 12 under the control of the first scanning signal Gate1 transmitted via the first scanning signal terminal GATE1.

The first driving unit 12 is also electrically connected to the first voltage signal terminal VDD and the first control unit 13, and is configured to generate a driving signal according to the written first data signal Data1 and the first voltage signal Vdd received at the first voltage signal terminal VDD, and then transmit the driving signal to the first control unit 13.

The first control unit 13 is also electrically connected to the enable signal terminal EM, the first voltage signal terminal VDD and the driving duration control sub-circuit 2, and is configured to transmit the driving signal to the driving duration control sub-circuit 2 according to the first voltage signal Vdd under the control of the enable signal Em transmitted via the enable signal terminal EM.

In the driving signal control sub-circuit 1, the first data signal Data1 is written into the first driving unit 12 through the first data writing unit 11; the first driving unit 12 generates the driving signal according to the first data signal Data1 and the first voltage signal Vdd, and transmits the driving signal to the first control unit 13; and the first control unit 13 transmits the driving signal to the driving duration control sub-circuit 2. In this way, the driving signal control sub-circuit 1 provides the driving signal to the driving duration control sub-circuit 2, and the driving signal is related to the first data signal Data1 and the first voltage signal Vdd.

In the above embodiments, the first driving unit 12 is electrically connected to the first voltage signal terminal VDD, that is, both the first driving unit 12 and the first control unit 13 are electrically connected to the first voltage signal terminal VDD. In this way, the first control unit 13 inputs the first voltage signal Vdd received at the first voltage signal terminal VDD to the first driving unit 12 under the control of the enable signal Em transmitted via the enable signal terminal EM. The first driving unit 12 generates the driving signal according to the first data signal Data1 written by the first data writing unit 11, the first voltage signal Vdd input by the first control unit 13 and the first voltage signal Vdd received at the first voltage signal terminal VDD, and transmits the driving signal to the first control unit 13. In addition, the magnitude of the driving signal is related to the first data signal Data1 and the first voltage signal Vdd.

In the above driving signal control sub-circuit 1, both the first driving unit 12 and the first control unit 13 are electrically connected to the first voltage signal terminal VDD, and receive the first voltage signal Vdd transmitted via the first voltage signal terminal VDD. There is no need to additionally provide a voltage signal terminal for separately providing a voltage signal to the first driving unit 12. Or, there is no need to additionally provide a voltage signal terminal for separately providing a voltage signal to the first control unit 13. In this way, the structure of the circuit is simplified. Moreover, on a display panel to which the pixel driving circuit 100 is applied, only a first voltage signal line configured to provide the first voltage signal Vdd to the first voltage signal terminal VDD is provided, and there is no need to additionally provide other voltage signal lines, which may reduce the number of wires and simplify the structure of the circuit.

Inventors of the present disclosure have discovered through research that by adopting the driving signal control sub-circuit 1, in some cases, since both the first driving unit 12 and the first control unit 13 are electrically connected to the first voltage signal terminal VDD, the driving signal generated by the first driving unit 12 passes through the first voltage signal terminal VDD. For example, the driving current generated by the first driving unit 12 passes through the first voltage signal terminal VDD, and then flows to the first voltage signal line. However, since the first voltage signal line has resistance, a voltage drop may occur when a current flows through the first voltage signal line.

In this way, it may cause that the first voltage signals Vdd received at the first voltage signal terminals VDD in the pixel driving circuits 100 are not consistent. For example, when the first voltage signal line transmits the first voltage signal Vdd, the greater the distance traveled by the first voltage signal Vdd is, the greater the voltage drop generated is. As a result, compared with a pixel driving circuit 100 that is closer to a signal source terminal of the first voltage signal Vdd, the first voltage signal Vdd received by a pixel driving circuit 100 that is farther from the signal source terminal of the first voltage signal Vdd decreases. In the pixel driving circuit 100 provided in the present disclosure, since the driving signal generated by the driving signal control sub-circuit 1 is related to the first data signal Data1 received at the first data signal terminal DATA1 and the first voltage signal Vdd received at the first voltage signal terminal VDD, the inconsistency of the first voltage signals Vdd received by the pixel driving circuits 100 will lead to the inconsistency of the magnitudes of the generated driving signals, resulting in an uneven display of the display panel.

Figure 2B:
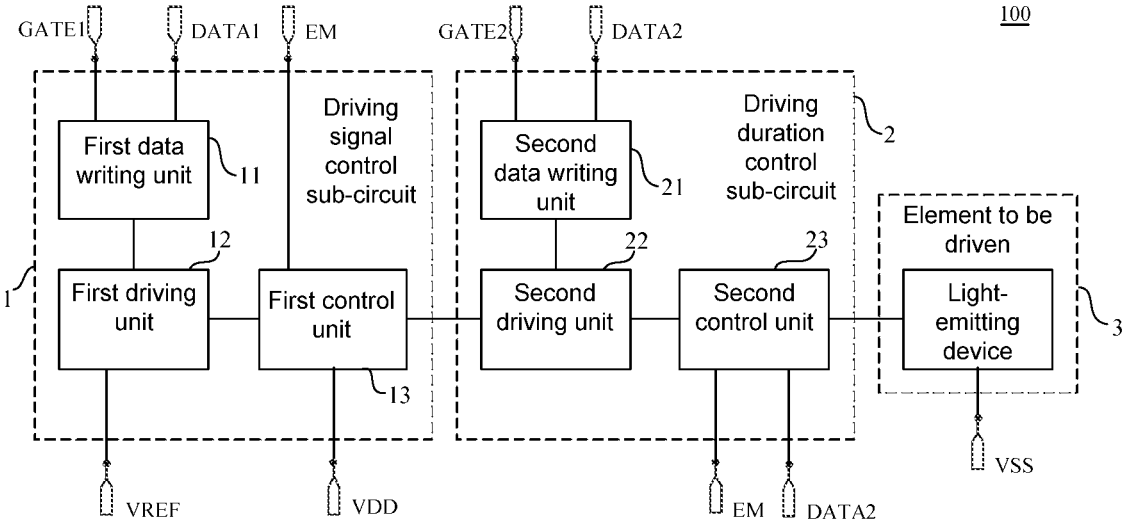
FIG. 2B is a schematic diagram showing yet another structure of a pixel driving circuit, according to some embodiments of the present disclosure.
Figure 3B:
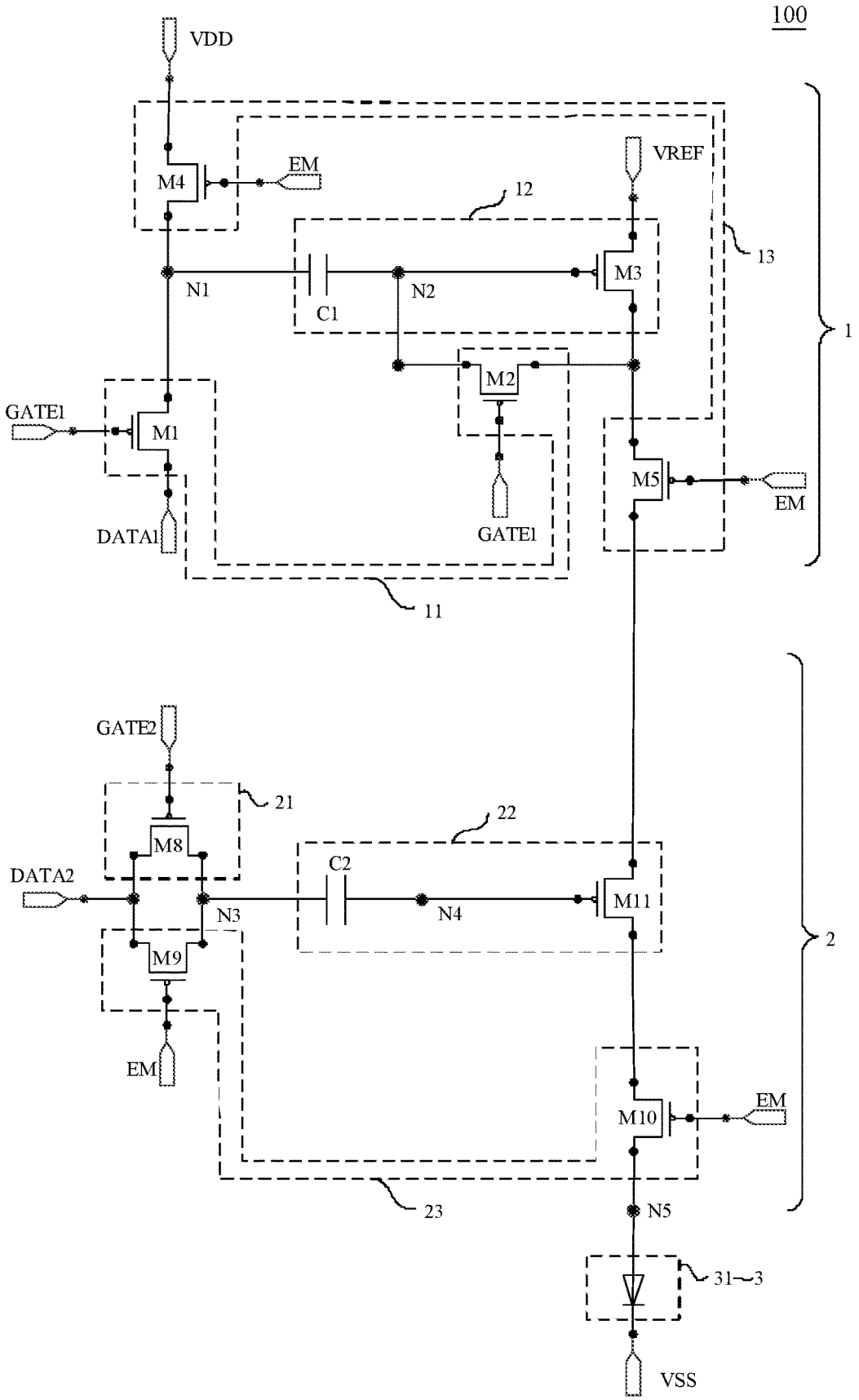
FIG. 3B is a schematic diagram showing yet another structure of a pixel driving circuit, according to some embodiments of the present disclosure.

In view of the above problems, in some embodiments, as shown in FIGS. 2B and 3B, the driving signal control sub-circuit 1 includes a first data writing unit 11, a first driving unit 12 and a first control unit 13.

The first data writing unit 11 is electrically connected to the first scanning signal terminal GATE1, the first data signal terminal DATA1 and the first driving unit 12, and is configured to write the first data signal Data1 received at the first data signal terminal DATA1 into the first driving unit 12 under the control of the first scanning signal Gate1 transmitted via the first scanning signal terminal GATE1.

The first control unit 13 is electrically connected to the enable signal terminal EM, the first voltage signal terminal VDD and the first driving unit 12, and is configured to input the first voltage signal Vdd received at the first voltage signal terminal VDD to the first driving unit 12 under the control of the enable signal Em transmitted via the enable signal terminal EM.

The first driving unit 12 is also electrically connected to a third voltage signal terminal VREF, and is configured to generate a driving signal according to the written first data signal Data1, the input first voltage signal Vdd and a third voltage signal Vref received at the third voltage signal terminal VREF, and then transmit the driving signal to the first control unit 13.

The first control unit 13 is also electrically connected to the driving duration control sub-circuit 2, and is configured to transmit the driving signal to the driving duration control sub-circuit 2 under the control of the enable signal Em transmitted via the enable signal terminal EM.

In the above driving signal control sub-circuit 1, the first data signal Data1 is written to the first driving unit 12 through the first data writing unit 11. The first driving unit 12 generates the driving signal according to the written first data signal Data1, the input first voltage signal Vdd and the third voltage signal Vref received at the third voltage signal terminal VREF, and then transmits the driving signal to the first control unit 13. The first control unit 13 transmits the driving signal to the driving duration control sub-circuit 2. In this way, the driving signal control sub-circuit 1 provides the driving signal to the driving duration control sub-circuit 2, and the driving signal is related to the first data signal Data1 and the first voltage signal Vdd.

In the above embodiment, the first driving unit 12 is electrically connected to the third voltage signal terminal VREF, and is configured to generate the driving signal according to the written first data signal Data1, the input first voltage signal Vdd and the third voltage signal Vref received at the third voltage signal terminal VREF, and then transmit the driving signal to the first control unit 13. The third voltage signal terminal VREF is configured to receive the third voltage signal Vref, and input the third voltage signal Vref to the driving signal control sub-circuit 1. That is, in the pixel driving circuit 100, the third voltage signal terminal VREF for providing the third voltage signal Vref to the first driving unit 12 is separately disposed.

In this way, in the display panel, the first voltage signal line configured to provide the first voltage signal Vdd to the first voltage signal terminal VDD is a signal line different from a third voltage signal line configured to provide the third voltage signal Vref to the third voltage signal terminal VREF. The driving current generated by the first driving unit 12 only flows through the third voltage signal line from the third voltage signal terminal VREF, and will not affect the first voltage signal line. As a result, the first voltage signal line is able to provide a stable first voltage signal Vdd to the first voltage signal terminal VDD of each pixel driving circuit 100, and the magnitude of the driving signal will not be affected. Therefore, the possible problem of the uneven display of the display panel may be avoided.

For example, as shown in FIG. 3B, the first data writing unit 11 includes a first transistor M1 and a second transistor M2.

A control electrode of the first transistor M1 is electrically connected to the first scanning signal terminal GATE1, a first electrode of the first transistor M1 is electrically connected to the first data signal terminal DATA1, and a second electrode of the first transistor M1 is electrically connected to the first driving unit 12. The first transistor M1 is configured to be turned on under the control of the first scanning signal Gate1 to transmit the first data signal Data1 to the first driving unit 12.

A control electrode of the second transistor M2 is electrically connected to the first scanning signal terminal GATE1, and a first electrode and a second electrode of the second transistor M2 are electrically connected to the first driving unit 12. In a case where the first driving unit 12 includes a third transistor M3, the second transistor M2 is configured to be turned on under the control of the first scanning signal Gate1, so as to make the third transistor M3 be in a self-saturation state.

The first driving unit 12 includes a first storage capacitor C1 and a third transistor M3.

A first end of the first storage capacitor C1 is electrically connected to the first data writing unit 11 and the first control unit 13, and a second end of the first storage capacitor C1 is electrically connected to the first data writing unit 11. The first storage capacitor C1 is configured to receive the first data signal Data1 input by the first data writing unit 11 and store the first data signal Data1.

A control electrode of the third transistor M3 is electrically connected to the second end of the first storage capacitor C1 and the first data writing unit 11, a first electrode of the third transistor M3 is electrically connected to the third voltage signal terminal VREF, and a second electrode of the third transistor M3 is electrically connected to the first data writing unit 11 and the first control unit 13. The third transistor M3 is configured to generate the driving signal according to the first data signal Data1 stored in the first storage capacitor C1, the first voltage signal Vdd input by the first control unit 13 and the third voltage signal Vref received at the third voltage signal terminal VREF, and then transmit the driving signal to the first control unit 13.

The first control unit 13 includes a fourth transistor M4 and a fifth transistor M5.

A control electrode of the fourth transistor M4 is electrically connected to the enable signal terminal EM, a first electrode of the fourth transistor M4 is electrically connected to the first voltage signal terminal VDD, and a second electrode of the fourth transistor M4 is electrically connected to the first driving unit 12. The fourth transistor M4 is configured to be turned on under the control of the enable signal Em to transmit the first voltage signal Vdd to the first driving unit 12.

A control electrode of the fifth transistor M5 is electrically connected to the enable signal terminal EM, a first electrode of the fifth transistor M5 is electrically connected to the first driving unit 12, and a second electrode of the fifth transistor M5 is electrically connected to the driving duration control sub-circuit 2. The fifth transistor M5 is configured to be turned on under the control of the enable signal Em to transmit the driving signal to the driving duration control sub-circuit 2.

Figure 4:
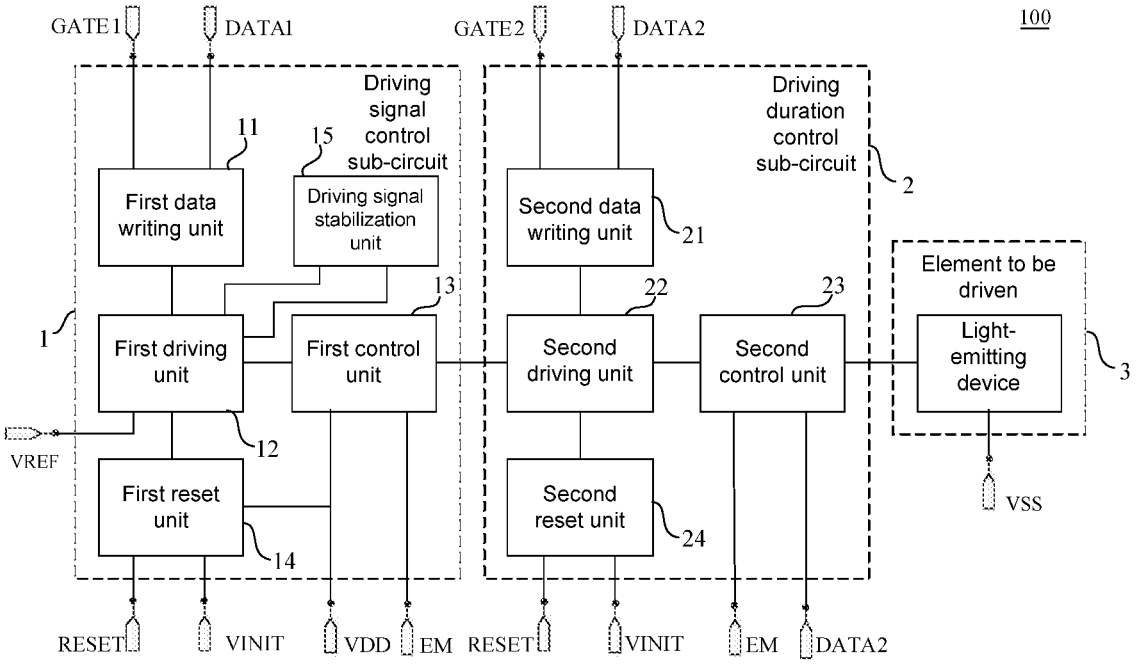
FIG. 4 is a schematic diagram showing yet another structure of a pixel driving circuit, according to some embodiments of the present disclosure.

In some embodiments, as shown in FIG. 4, the driving signal control sub-circuit 1 further includes a first reset unit 14.

The first reset unit 14 is electrically connected to the first voltage signal terminal VDD, a reset signal terminal RESET, an initialization signal terminal VINIT and the first driving unit 12. The reset signal terminal RESET is configured to receive a reset signal Reset and input the reset signal Reset to the first reset unit 14; and the initialization signal terminal VINIT is configured to receive an initialization signal Vinit and input the initialization signal Vinit to the first reset unit 14.

The first reset unit 14 is configured to reset a voltage of the first driving unit 12 under the control of the reset signal Reset transmitted via the reset signal terminal RESET according to the first voltage signal Vdd received at the first voltage signal terminal VDD and the initialization signal Vinit received at the initialization signal terminal VINIT.

In the above embodiment, the voltage of the first driving unit 12 is reset through the first reset unit 14, so as to reduce noise of the signal at the first driving unit 12. As a result, when the first data writing unit 11 writes the first data signal Data1 into the first driving unit 12, the input first data signal Data1 is more accurate.

Figure 5A:
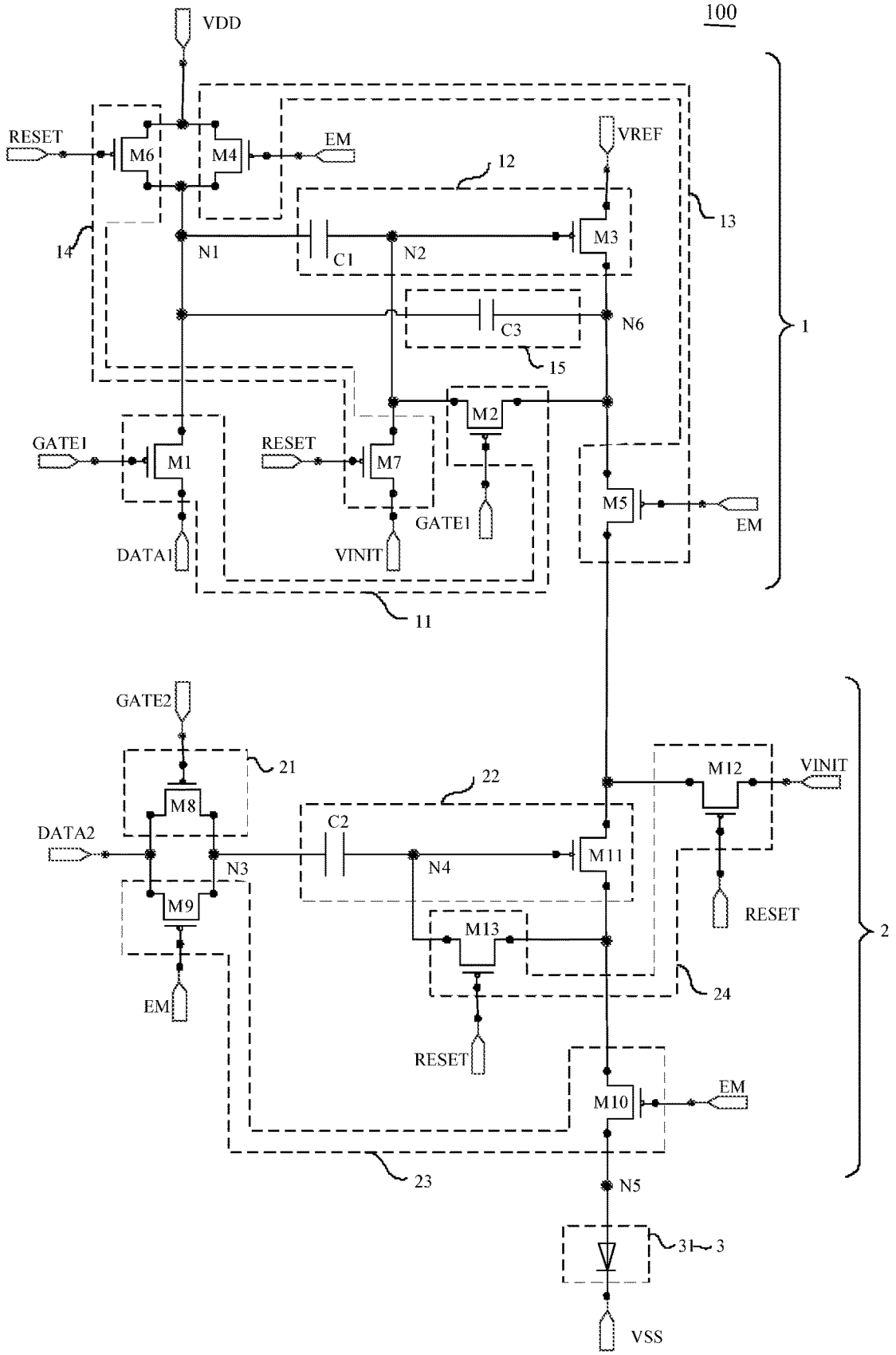
FIG. 5A is a schematic diagram showing yet another structure of a pixel driving circuit, according to some embodiments of the present disclosure.
Figure 5B:
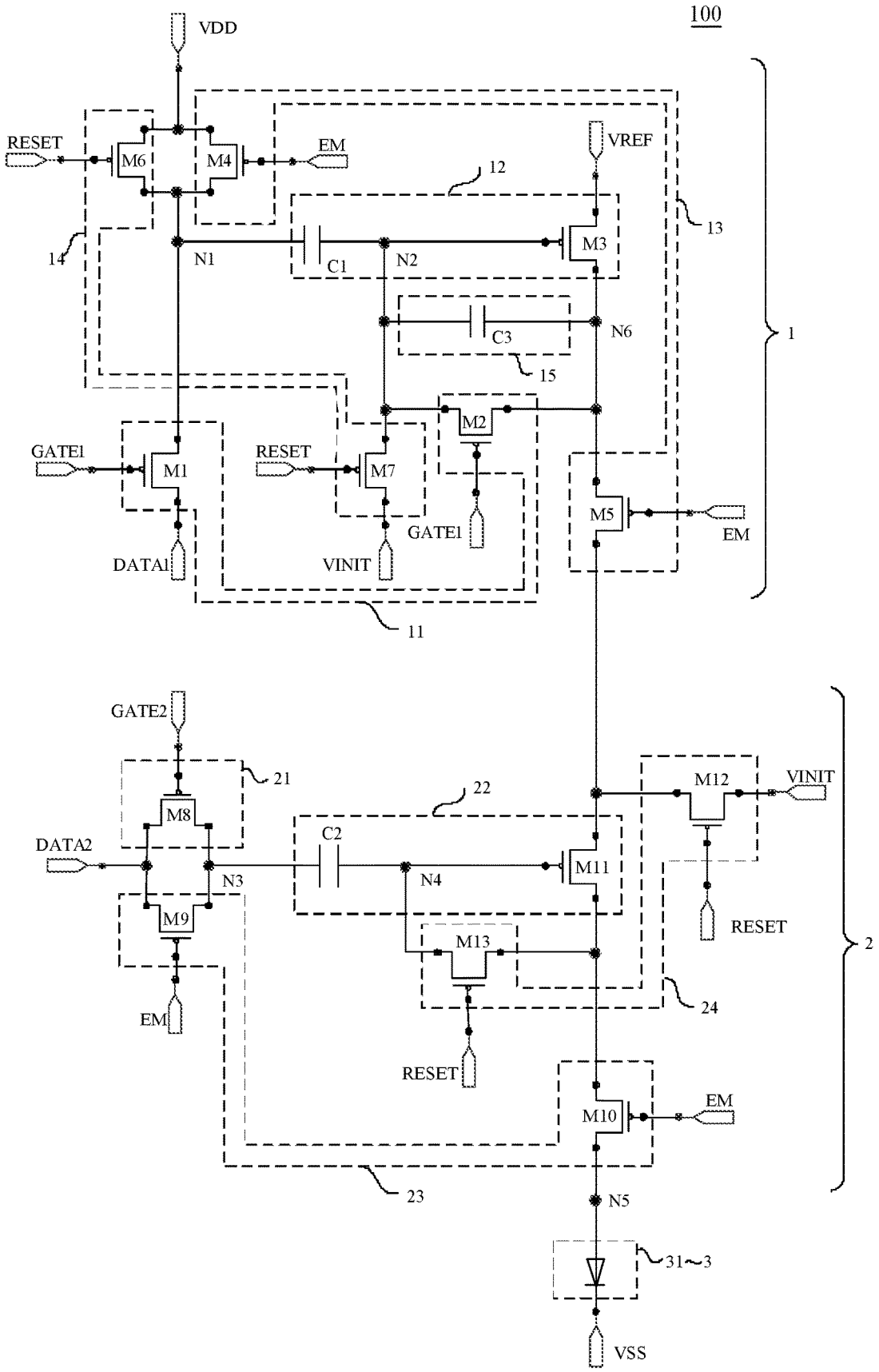
FIG. 5B is a schematic diagram showing yet another structure of a pixel driving circuit, according to some embodiments of the present disclosure.

For example, as shown in FIGS. 5A and 5B, the first reset unit 14 includes a sixth transistor M6 and a seventh transistor M7.

A control electrode of the sixth transistor M6 is electrically connected to the reset signal terminal RESET, a first electrode of the sixth transistor M6 is electrically connected to the first voltage signal terminal VDD, and a second electrode of the sixth transistor M6 is electrically connected to the first driving unit 12. The sixth transistor M6 is configured to be turned on under the control of the reset signal Reset to transmit the first voltage signal Vdd to the first driving unit 12.

A control electrode of the seventh transistor M7 is electrically connected to the reset signal terminal RESET, a first electrode of the seventh transistor M7 is electrically connected to the initialization signal terminal VINIT, and a second electrode of the seventh transistor M7 is electrically connected to the first driving unit 12. The seventh transistor M7 is configured to be turned on under the control of the reset signal Reset to transmit the initialization signal Vinit to the first driving unit 12.

Figure 9:
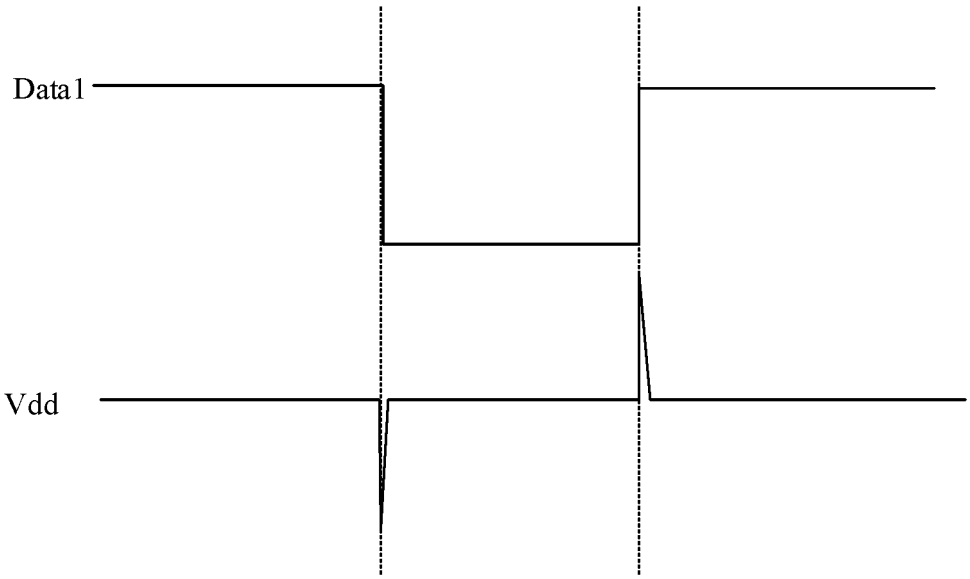
FIG. 9 is a schematic diagram showing a signal crosstalk.

Since there are many signal lines in the display panel, in some cases, a crosstalk phenomenon may occur between two adjacent signal lines (e.g., two neighbouring signal lines, or two signal lines separated by a relatively short distance, or two signal lines, orthographic projections of which on a base substrate of the display panel overlap) in the display panel due to the existence of coupling capacitance and mutual inductance between signal lines. In the pixel driving circuit 100 provided in the present disclosure, the first voltage signal Vdd may be affected by other signals and thus be distorted. For example, as shown in FIG. 9, the first voltage signal Vdd is affected by a level jump of the first data signal Data1; at a rising edge of the first data signal Data1, a level of the first voltage signal Vdd will undergo a pull-up jump and then recover, and at a falling edge of the first data signal Data1, the level of the first voltage signal Vdd will undergo a pull-down jump and then recover. The recovery time after the jump occurs is affected by a resistive load and a capacitive load existing in the first voltage signal line used to transmit the first voltage signal Vdd. In a case where the first voltage signal line has a large resistive load and a large capacitive load, the recovery time of the first voltage signal Vdd after the jump occurs is long, which causes a problem of instability of the first voltage signal Vdd received by the pixel driving circuit 100 to be more significant.

In this case, referring to FIG. 3B, when the potential of the first voltage signal Vdd undergoes the pull-down jump, in a case where the fourth transistor M4 is turned on under the control of the enable signal Em to transmit the first voltage signal Vdd to the first storage capacitor C1 in the first driving unit 12, a potential at the first end of the first storage capacitor C1 undergoes a pull-down jump. According to the law of conservation of charge of the capacitor, a potential at the second end of the first storage capacitor C1 also undergoes a pull-down jump. The potential at the second end of the first storage capacitor C1 is equal to a potential at the control electrode of the third transistor M3, and therefore the potential at the control electrode of the third transistor M3 undergoes a pull-down jump. A potential at the first electrode of the third transistor M3 is a potential of the third voltage signal Vref, and in a ease where the potential remains unchanged, a gate-source voltage difference of the third transistor M3 decreases.

Figure 10:
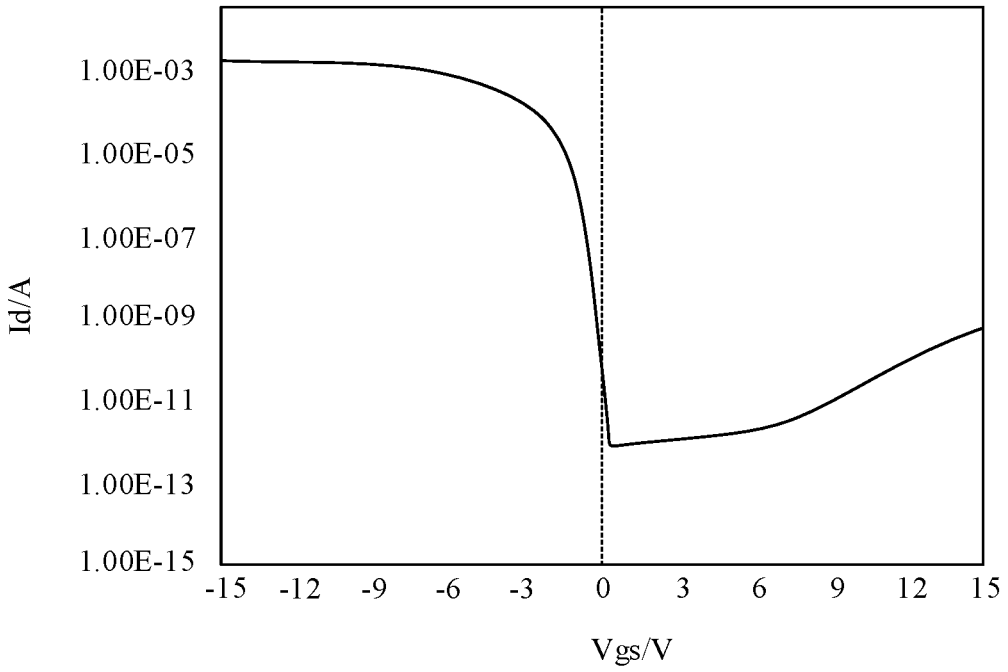
FIG. 10 is a schematic diagram of an I-V characteristic curve of a transistor, according to some embodiments.

According to the I-V characteristics of a transistor, in a case where a gate-source voltage difference of a control electrode of the transistor changes, the current generated by the transistor also changes. Taking a P-type transistor as an example, when an absolute value of a gate-source voltage difference of the P-type transistor is greater than an absolute value of its threshold voltage, the P-type transistor is turned on, and a current is generated. When the P-type transistor is turned on, the gate-source voltage difference of the P-type transistor is less than zero. As shown in FIG. 10, according to the I-V characteristics of the P-type transistor, the relationship between the current Id generated by the P-type transistor and the gate-source voltage difference Vgs of the P-type transistor is that, in a case where the gate-source voltage difference Vgs of the P-type transistor is less than 0 V (that is, the P-type transistor is turned on and generates current), the current generated by the P-type transistor increases as the gate-source voltage difference Vgs of the P-type transistor decreases.

In this way, referring to FIG. 3B, in a case where the third transistor M3 is a P-type transistor, the decrease of the gate-source voltage difference of the third transistor M3 causes the driving current generated by the third transistor M3 to increase. The third transistor M3 itself has resistance, and the increase of the driving current generated by the third transistor M3 indicates that the resistance of the third transistor M3 decreases, so that the generated voltage drop decreases. In a case where the potential at the first electrode of the third transistor M3 (i.e., the potential of the third voltage signal Vref) is not changed, a potential at the second electrode of the third transistor M3 rises, and the pull-up jump instantaneously occurs. That is, the driving signal generated by the first driving unit 12 is affected by the pull-down jump of the potential of the first voltage signal Vdd, and will instantaneously increase, so that the potential at the second electrode of the third transistor undergoes the pull-up jump instantaneously.

Similarly when the potential of the first voltage signal Vdd undergoes the pull-up jump, the driving current generated by the third transistor M3 decreases, which indicates that the resistance of the third transistor M3 itself increases, and the generated voltage drop increases. In a case where the potential at the first electrode of the third transistor M3 (i.e., the potential of the third voltage signal Vref) is not changed, the potential at the second electrode of the third transistor M3 decreases, and the pull-down jump instantaneously occurs. That is, the driving signal generated by the first driving unit 12 is affected by the pull-up jump of the first voltage signal Vdd, and will instantaneously decrease, so that the potential at the second electrode of the third transistor M3 undergoes the pull-down jump instantaneously.

In this way, the change of the driving signal generated by the first driving unit 12 affects the operation of the element 3 to be driven. For example, in a case where the element 3 to be driven is a light-emitting device, the luminous intensity of the element 3 to be driven changes under the influence of the change of the driving signal, thereby resulting in a poor display of the displayed image.

In view of the possible problem of the poor display caused by the signal crosstalk, in some embodiments, as shown in FIG. 4, the driving signal control sub-circuit 1 further includes a driving signal stabilization unit 15. The driving signal stabilization unit 15 is electrically connected to the first driving unit 12, and is configured to stabilize the driving signal generated by the first driving unit 12.

In the driving signal control sub-circuit 1 provided by the above embodiment, the driving signal generated by the first driving unit 12 is stabilized through the driving signal stabilization unit 15. In this way, a problem that the magnitude of the driving signal generated by the first driving unit 12 is affected may be avoided, which is caused by the jump of the first voltage signal Vdd due to the interference of other signals, and it may ensure that the element 3 to be driven works normally under the action of the driving signal, which ensures the normal display of the image.

For example, as shown in FIGS. 5A and 5B, the driving signal stabilization unit 15 includes a voltage stabilizing storage capacitor C3.

In a case where the first driving unit 12 includes the first storage capacitor C1 and the third transistor M3, in some examples, as shown in FIG. 5A, a first end of the voltage stabilizing storage capacitor C3 is electrically connected to the first end of the first storage capacitor C1, and a second end of the voltage stabilizing storage capacitor C3 is electrically connected to the second electrode of the third transistor M3.

For convenience of description, a node where the second electrode of the first transistor M1 and the first end of the first storage capacitor C1 are electrically connected is equivalent to a first node N1. That is, a potential at the first node N1 is the same as the potential at the first end of the first storage capacitor C1, a potential at the second electrode of the first transistor M1 and a potential at the first end of the voltage stabilizing storage capacitor C3. A node where the control electrode of the third transistor M3 and the second end of the first storage capacitor C1 are electrically connected is equivalent to a second node N2. That is, a potential at the second node N2 is the same as the potential at the second end of the first storage capacitor C1 and the potential at the control electrode of the third transistor M3. A node where the second end of the voltage stabilizing storage capacitor C3 and the second electrode of the third transistor M3 are electrically connected is equivalent to a sixth node N6. That is, a potential at the sixth node N6 is the same as the potential at the second end of the voltage stabilizing storage capacitor C3 and the potential at the second electrode of the third transistor M3.

The voltage stabilizing storage capacitor C3 is disposed between the first end of the first storage capacitor C1 and the second electrode of the third transistor M3. In this way, when the first voltage signal Vdd is affected by the change of the potential of the first data signal Data1, a potential jump occurs. For example, the potential of the first voltage signal Vdd undergoes the pull-down jump, and the potential at the first end of the first storage capacitor C1 (the potential at the first node N1) undergoes the pull-down jump. The potential at the first end of the voltage stabilizing storage capacitor C3 is the same as the potential at the first node N1, as a result, the potential at the first end of the voltage stabilizing storage capacitor C3 also undergoes a pulleddown change. According to the law of conservation of charge of the capacitor, the potential at the second end of the voltage stabilizing storage capacitor C3 (the potential at the sixth node N6) also undergoes a pull-down change.

According to the above analysis of the poor display caused by the signal crosstalk, it can be seen that the driving signal generated by the first driving unit 12 is affected by the pull-down jump of the potential of the first voltage signal Vdd, and increases instantaneously, which causes the potential at the second electrode of the third transistor (the potential at the sixth node N6) to undergo the pull-up jump instantaneously. The change of the potential at the second electrode of the third transistor (the potential at the sixth node N6) is counteracted under the action of the voltage stabilizing storage capacitor C3, which is equivalent to the fact that there is no change in the driving signal generated by the first driving unit 12, or the change is so small and can be ignored, and thereby the driving signal is hardly affected by the jump of the potential of the first voltage signal Vdd. Similarly, when the potential of the first voltage signal Vdd undergoes the pull-up jump, the change of the potential at each node may refer to the above description, which will not be repeated herein.

As a result, in a case where the driving signal generated by the first driving unit 12 is not affected by the jump of the potential of the first voltage signal Vdd, the element 3 to be driven is hardly affected in operation and can operate normally, which ensures the normal display of the image.

In some other examples, as shown in FIG. 5B, the first end of the voltage stabilizing storage capacitor C3 is electrically connected to the second end of the first storage capacitor C1, and the second end of the voltage stabilizing storage capacitor C3 is electrically connected to the second electrode of the third transistor M3.

The voltage stabilizing storage capacitor C3 is disposed between the second end of the first storage capacitor C1 and the second electrode of the third transistor M3. In this way, in a case where the first voltage signal Vdd is affected by the change of the potential of the first data signal Data1, and undergoes the potential jump, for example, the potential of the first voltage signal Vdd undergoes the pull-down jump, the potential at the first end of the first storage capacitor C1 (the potential at the first node N1) undergoes the pull-down jump. According to the law of conservation of charge of the capacitor, the potential at the second end of the first storage capacitor C1 (the potential at the second node N2) also undergoes the pull-down jump, and the potential at the first end of the voltage stabilizing storage capacitor C3 is the same as the potential at the second node N2. As a result, the potential at the first end of the voltage stabilizing storage capacitor C3 also undergoes the pull-down change. According to the law of conservation of charge of the capacitor, the potential at the second end of the voltage stabilizing storage capacitor C3 (the potential at the sixth node N6) also undergoes the pull-down change.

According to the above analysis of the poor display caused by the signal crosstalk, it can be seen that the driving signal generated by the first driving unit 12 is affected by the pull-down jump of the potential of the first voltage signal Vdd, and increases instantaneously, which causes the potential at the second electrode of the third transistor (the potential at the sixth node N6) to undergo the pull-up jump instantaneously. The change of the potential at the second electrode of the third transistor (the potential at the sixth node N6) is counteracted under the action of the voltage stabilizing storage capacitor C3, which is equivalent to the fact that there is no change in the driving signal generated by the first driving unit 12, or the change is so small and can be ignored, and thereby the driving signal is hardly affected by the jump of the potential of the first voltage signal Vdd. Similarly, when the potential of the first voltage signal Vdd undergoes the pull-up jump, the change of the potential at each node may refer to the above description, which will not be repeated herein.

As a result, in a case where the driving signal generated by the first driving unit 12 is not affected by the jump of the potential of the first voltage signal Vdd, the element 3 to be driven is hardly affected in operation and can operate normally, which ensures the normal display of the image.

In some embodiments, the driving signal stabilization unit 15 may include other devices, which is not limited in the present disclosure, as long as it may stabilize the driving signal generated by the first driving unit 12.

On this basis, a specific circuit structure of the driving signal control sub-circuit 1 included in the pixel driving circuit 100 provided by the embodiments of the present disclosure will be described integrally and exemplarily.

As shown in FIGS. 5A and 5B, the driving signal control sub-circuit 1 includes the first transistor M1, the second transistor M2, the third transistor M3, the fourth transistor M4, the fifth transistor M5, the sixth transistor M6, the seventh transistor M7, the first storage capacitor C1 and the voltage stabilizing storage capacitor C3.

The control electrode of the first transistor M1 is electrically connected to the first scanning signal terminal GATE1, the first electrode of the first transistor M1 is electrically connected to the first data signal terminal DATA1, and the second electrode of the first transistor M1 is electrically connected to the first end of the first storage capacitor C1. The first transistor M1 is configured to be turned on under the control of the first scanning signal Gate1 to transmit the first data signal Data1 to the first end of the first storage capacitor C1.

The control electrode of the second transistor M2 is electrically connected to the first scanning signal terminal GATE1, a first electrode of the second transistor M2 is electrically connected to the second electrode of the third transistor M3, and a second electrode of the second transistor M2 is electrically connected to the second end of the first storage capacitor C1 and the control electrode of the third transistor M3. The second transistor M2 is configured to be turned on under the control of the first scanning signal Gate1, so as to connect the control electrode of the third transistor M3 to the second electrode of the third transistor M3, so that the third transistor M3 reaches a self-saturation state.

The control electrode of the third transistor M3 is also electrically connected to the second end of the first storage capacitor C1, the first electrode of the third transistor M3 is electrically connected to the third voltage signal terminal VREF, and the second electrode of the third transistor M3 is also electrically connected to the first electrode of the fifth transistor M5. The third transistor M3 is configured to generate the driving signal according to the first data signal Data1 stored in the first storage capacitor C1, the first voltage signal Vdd input by the first control unit 13 and the third voltage signal Vref, and then transmit the driving signal to the first electrode of the fifth transistor M5.

The control electrode of the fourth transistor M4 is electrically connected to the enable signal terminal EM, the first electrode of the fourth transistor M4 is electrically connected to the first voltage signal terminal VDD, and the second electrode of the fourth transistor M4 is electrically connected to the first end of the first storage capacitor C1.

The fourth transistor M4 is configured to be turned on under the control of the enable signal Em to transmit the first voltage signal Vdd to the first end of the first storage capacitor C1.

The control electrode of the fifth transistor M5 is electrically connected to the enable signal terminal EM, and the second electrode of the fifth transistor M5 is electrically connected to the driving duration control sub-circuit 2. The fifth transistor M5 is configured to be turned on under the control of the enable signal Em to transmit the driving signal to the driving duration control sub-circuit 2.

The control electrode of the sixth transistor M6 is electrically connected to the reset signal terminal RESET, the first electrode of the sixth transistor M6 is electrically connected to the first voltage signal terminal VDD, and the second electrode of the sixth transistor M6 is electrically connected to the first end of the first storage capacitor C1. The sixth transistor M6 is configured to be turned on under the control of the reset signal Reset to transmit the first voltage signal Vdd to the first end of the first storage capacitor C1.

The control electrode of the seventh transistor M7 is electrically connected to the reset signal terminal RESET, the first electrode of the seventh transistor M7 is electrically connected to the initialization signal terminal VINIT, and the second electrode of the seventh transistor M7 is electrically connected to the second end of the first storage capacitor C1 and the control electrode of the third transistor M3. The seventh transistor M7 is configured to be turned on under the control of the reset signal Reset to transmit the initialization signal Vinit to the second end of the first storage capacitor C1.

The first end of the voltage stabilizing storage capacitor C3 is electrically connected to the first end of the first storage capacitor C1, and the second end of the voltage stabilizing storage capacitor C3 is electrically connected to the second electrode of the third transistor M3. Or, the first end of the voltage stabilizing storage capacitor C3 is electrically connected to the second end of the first storage capacitor C1, and the second end of the voltage stabilizing storage capacitor C3 is electrically connected to the second electrode of the third transistor M3.

In some embodiments, in the pixel driving circuit 100 provided by the present disclosure, the first transistor M1, the second transistor M2, the third transistor M3, the fourth transistor M4, the fifth transistor M5, the sixth transistor M6, and the seventh transistor M7 are all P-type transistors or all N-type transistors.

In some embodiments, as shown in FIGS. 2A and 2B, the driving duration control sub-circuit 2 in the pixel driving circuit 100 provided by the present disclosure includes a second data writing unit 21, a second control unit 23 and a second driving unit 22.

The second data writing unit 21 is electrically connected to the second scanning signal terminal GATE2, the second data signal terminal DATA2 and the second driving unit 22, and is configured to write a second data signal Data2 having a given working potential received at the second data signal terminal DATA2 into the second driving unit 22 under the control of the second scanning signal Gate2 transmitted via the second scanning signal terminal GATE2.

It will be noted that, the duration for transmitting the driving signal to the element 3 to be driven is related to the second data signal Data2 having the given working potential. By controlling the given working potential of the second data signal Data2, the duration for transmitting the driving signal to the element 3 to be driven may be changed, so that the working duration of the element 3 to be driven may be changed.

The second control unit 23 is electrically connected to the enable signal terminal EM, the second data signal terminal DATA2 and the second driving unit 22, and is configured to transmit a second data signal Data2 having a potential changing within a given range received at the second data signal terminal DATA2 to the second driving unit 22 under the control of the enable signal Em transmitted via the enable signal terminal EM.

It will be noted that, the duration for transmitting the driving signal to the element 3 to be driven is related to the second data signal Data2 having the potential changing within the given range. In a case where the potential of the second data signal Data2 changes to a certain value, the second driving unit 22 transmits the driving signal to the second control unit 23.

The second driving unit 22 is also electrically connected to the driving signal control sub-circuit 1, and is configured to transmit the driving signal to the second control unit 23 and control the duration for transmitting the driving signal to the second control unit 23 according to the second data signal Data2 having the given working potential and the second data signal Data2 having the potential changing within the given range.

The second control unit 23 is also electrically connected to the element 3 to be driven, and is also configured to transmit the driving signal to the element 3 to be driven.

In the driving duration control sub-circuit 2, the second data signal Data2 having the given working potential is written into the second driving unit 22 through the second data writing unit 21; the second data signal Data2 having the potential changing within the given range is transmitted to the second driving unit 22 through the second control unit 23; and the driving signal is transmitted to the second control unit 23 and the duration for transmitting the driving signal to the second control unit 23 is controlled through the second driving unit 22 according to the second data signal Data2 having the given working potential and the second data signal Data2 having the potential changing within the given range. As a result, the driving duration control sub-circuit 2 achieves an effect of controlling the duration for transmitting the driving signal to the second control unit 23 to control the working duration of the element 3 to be driven and further control the working state of the element 3 to be driven.

For example, as shown in FIGS. 3A and 3B, the second data writing unit 21 includes an eighth transistor M8.

A control electrode of the eighth transistor M8 is electrically connected to the second scanning signal terminal GATE2, a first electrode of the eighth transistor M8 is electrically connected to the second data signal terminal DATA2, and a second electrode of the eighth transistor M8 is electrically connected to the second driving unit 22. The eighth transistor M8 is configured to be turned on under the control of the second scanning signal Gate2 to transmit the second data signal Data2 to the second driving unit 22.

The second control unit 23 includes a ninth transistor M9 and a tenth transistor M10.

A control electrode of the ninth transistor M9 is electrically connected to the enable signal terminal EM, a first electrode of the ninth transistor M9 is electrically connected to the second data signal terminal DATA2, and a second electrode of the ninth transistor M9 is electrically connected to the second driving unit 22. The ninth transistor M9 is configured to be turned on under the control of the enable signal Em to transmit the second data signal Data2 to the second driving unit 22.

A control electrode of the tenth transistor M10 is electrically connected to the enable signal terminal EM, a first electrode of the tenth transistor M10 is electrically connected to the second driving unit 22, and a second electrode of the tenth transistor M10 is electrically connected to the element 3 to be driven. The tenth transistor M10 is configured to be turned on under the control of the enable signal Em to transmit the driving signal to the element 3 to be driven.

The second driving unit 22 includes a second storage capacitor C2 and an eleventh transistor M11.

A first end of the second storage capacitor C2 is electrically connected to the second data writing unit 21 and the second control unit 23, and is configured to receive the second data signal Data2 and store the second data signal Data2.

A control electrode of the eleventh transistor M11 is electrically connected to a second end of the second storage capacitor C2, a first electrode of the eleventh transistor M11 is electrically connected to the driving signal control sub-circuit 1, and a second electrode of the eleventh transistor M11 is electrically connected to the second control unit 23. The eleventh transistor M11 is configured to be turned on under the control of a voltage of the second end of the second storage capacitor C2 to transmit the driving signal to the tenth transistor M10.

In some embodiments, as shown in FIG. 4, the driving duration control sub-circuit 2 further includes a second reset unit 24.

The second reset unit 24 is electrically connected to the reset signal terminal RESET, the initialization signal terminal VINIT and the second driving unit 22, and is configured to reset the voltage of the second driving unit 22 under the control of the reset signal Reset transmitted via the reset signal terminal RESET according to the initialization signal Vinit received at the initialization signal terminal VINIT.

In the above embodiment, the voltage of the second driving unit 22 is reset through the second reset unit 24 to reduce the noise of the signal at the second driving unit 22. As a result, when the second data writing unit 21 writes the second data signal Data2 into the second driving unit 22, the input second data signal Data2 is more accurate.

For example, as shown in FIGS. 5A and 5B, the second reset unit 24 includes a twelfth transistor M12 and a thirteenth transistor M13.

A control electrode of the twelfth transistor M12 is electrically connected to the reset signal terminal RESET, a first electrode of the twelfth transistor M12 is electrically connected to the initialization signal terminal VINIT, and a second electrode of the twelfth transistor M12 is electrically connected to the second driving unit 22. The twelfth transistor M12 is configured to be turned on under the control of the reset signal Reset to transmit the initialization signal Vinit to the second driving unit 22.

A control electrode of the thirteenth transistor M13 is electrically connected to the reset signal terminal RESET, and a first electrode and a second electrode of the thirteenth transistor M13 are electrically connected to the second driving unit 22. The thirteenth transistor M13 is configured to be turned on under the control of the reset signal Reset, and the control electrode of the eleventh transistor M11 is electrically connected to the second electrode thereof, so that the eleventh transistor M11 is in a self-saturation state.

On this basis, a specific circuit structure of the driving duration control sub-circuit 2 included in the pixel driving circuit 100 provided by the embodiments of the present disclosure will be described integrally and exemplarily.

As shown in FIGS. 5A and 5B, the driving duration control sub-circuit 2 includes the eighth transistor M8, the ninth transistor M9, the tenth transistor M10, the eleventh transistor M11, the twelfth transistor M12, the thirteenth transistor M13 and the second storage capacitor C2.

The control electrode of the eighth transistor M8 is electrically connected to the second scanning signal terminal GATE2, the first electrode of the eighth transistor M8 is electrically connected to the second data signal terminal DATA2, and the second electrode of the eighth transistor M8 is electrically connected to the first end of the second storage capacitor C2. The eighth transistor M8 is configured to be turned on under the control of the second scanning signal Gate2 to transmit the second data signal Data2 to the first end of the second storage capacitor C2.

The control electrode of the ninth transistor M9 is electrically connected to the enable signal terminal EM, the first electrode of the ninth transistor M9 is electrically connected to the second data signal terminal DATA2, and the second electrode of the ninth transistor M9 is electrically connected to the first end of the second storage capacitor C2. The ninth transistor M9 is configured to be turned on under the control of the enable signal Em to transmit the second data signal Data2 to the second storage capacitor C2.

The control electrode of the tenth transistor M10 is electrically connected to the enable signal terminal EM, the first electrode of the tenth transistor M10 is electrically connected to the second electrode of the eleventh transistor M11, and the second electrode of the tenth transistor M10 is electrically connected to the element 3 to be driven. The tenth transistor M10 is configured to be turned on under the control of the enable signal Em to transmit the driving signal to the element 3 to be driven.

The control electrode of the eleventh transistor M11 is electrically connected to the second end of the second storage capacitor C2, the first electrode of the eleventh transistor M11 is electrically connected to the driving signal control sub-circuit 1 and the second electrode of the twelfth transistor M12, and the second electrode of the eleventh transistor M11 is also electrically connected to the first electrode of the thirteenth transistor M13. The eleventh transistor M11 is configured to be turned on under the control of the voltage of the second end of the second storage capacitor C2 to transmit the driving signal to the tenth transistor M10.

The control electrode of the twelfth transistor is electrically connected to the reset signal terminal RESET, and the first electrode of the twelfth transistor is electrically connected to the initialization signal terminal VINIT. The twelfth transistor M12 is configured to be turned on under the control of the reset signal Reset to transmit the initialization signal Vinit to the second driving unit 22.

The control electrode of the thirteenth transistor M13 is electrically connected to the reset signal terminal RESET, and the second electrode of the thirteenth transistor M13 is electrically connected to the second end of the second storage capacitor C2 and the control electrode of the eleventh transistor M11. The thirteenth transistor M13 is configured to be turned on under the control of the reset signal Reset, and the control electrode of the eleventh transistor M11 is connected to the second electrode thereof, so that the eleventh transistor M11 is in a self-saturation state.

In some embodiments, the eighth transistor M8, the ninth transistor M9, the tenth transistor M10, the eleventh transistor M11, the twelfth transistor M12, and the thirteenth transistor M13 are all P-type transistors or all N-type transistors.

Specific structures of the driving signal control sub-circuit 1 and the driving duration control sub-circuit 2 have been exemplarily introduced above. In some embodiments, as shown in FIGS. 5A and 5B, the driving signal control sub-circuit 1 in the pixel driving circuit 100 provided by some embodiments of the present disclosure includes: the first transistor M1, the second transistor M2, the third transistor M3, the fourth transistor M4, the fifth transistor M5, the sixth transistor M6, the seventh transistor M7, the first storage capacitor C1 and the voltage stabilizing storage capacitor C3, and connection manners of the elements may refer to the corresponding introductions above. In addition, the driving duration control sub-circuit 2 in the pixel driving circuit 100 includes: the eighth transistor M8, the ninth transistor M9, the tenth transistor M10, the eleventh transistor M11, the twelfth transistor M12, the thirteenth transistor M13 and the second storage capacitor C2, and connection manners of the elements are as described in the corresponding parts above. The transistors above may all be P-type transistors or N-type transistors.

In some embodiments, as shown in FIGS. 3B, 5A and 5B, the element 3 to be driven includes at least one light-emitting diode 31 connected in series in a current path. An anode of one light-emitting diode 31 is electrically connected to the second electrode of the tenth transistor M10, and a node where the anode of the light-emitting diode 31 is electrically connected to the second electrode of the tenth transistor M10 is equivalent to a fifth node N5. A cathode of the light-emitting diode 31 is electrically connected to a signal terminal. For example, the signal terminal is a second voltage signal terminal VSS. In a case where the tenth transistor M10 is a P-type transistor, the second voltage signal terminal VSS may be grounded, or be with a value of 0 V.

In some embodiments, the light-emitting diode 31 is a micro light-emitting diode (micro LED), a mini light-emitting diode (mini LED), an organic light-emitting diode, a quantum dot light-emitting diode or other light-emitting device that have high luminous efficiency at a high current density and low luminous efficiency at a low current density, which is not limited in the embodiments of the present disclosure.

It will be noted that, the transistors used in the circuit provided by the embodiments of the present disclosure may be thin film transistors, field-effect transistors or other switching devices with same characteristics, which is not limited in the embodiments of the present disclosure.

In some embodiments, a control electrode of each transistor used in the pixel driving circuit 100 is a gate of the transistor, a first electrode of the transistor is one of a source and a drain of the transistor, and a second electrode of the transistor is the other one of the source and the drain of the transistor. Since the source and the drain of the transistor may be symmetrical in structure, there may be no difference in structure between the source and the drain of the transistor. That is, the first electrode and the second electrode of the transistor in the embodiments of the present disclosure may be the same in structure. For example, in a case where the transistor is a P-type transistor, the first electrode of the transistor is the source, and the second electrode thereof is the drain. For example, in a case where the transistor is an N-type transistor, the first electrode of the transistor is the drain, and the second electrode thereof is the source.

In the embodiments of the present disclosure, specific implementation manners of the driving signal control sub-circuit 1 and the driving duration control sub-circuit 2 are not limited to the manners described above, and may be any implementation manner as used, such as a conventional connection manner well known to a person skilled in the art, as long as the realization of corresponding functions may be guaranteed. The above examples do not limit the protection scope of the present disclosure. In practical applications, a person skilled in the art may choose to use or not to use one or more of the above circuits according to actual situations. Various combinations and modifications based on the above circuits do not depart from the principle of the present disclosure, and details are not described herein again.

Figure 6:
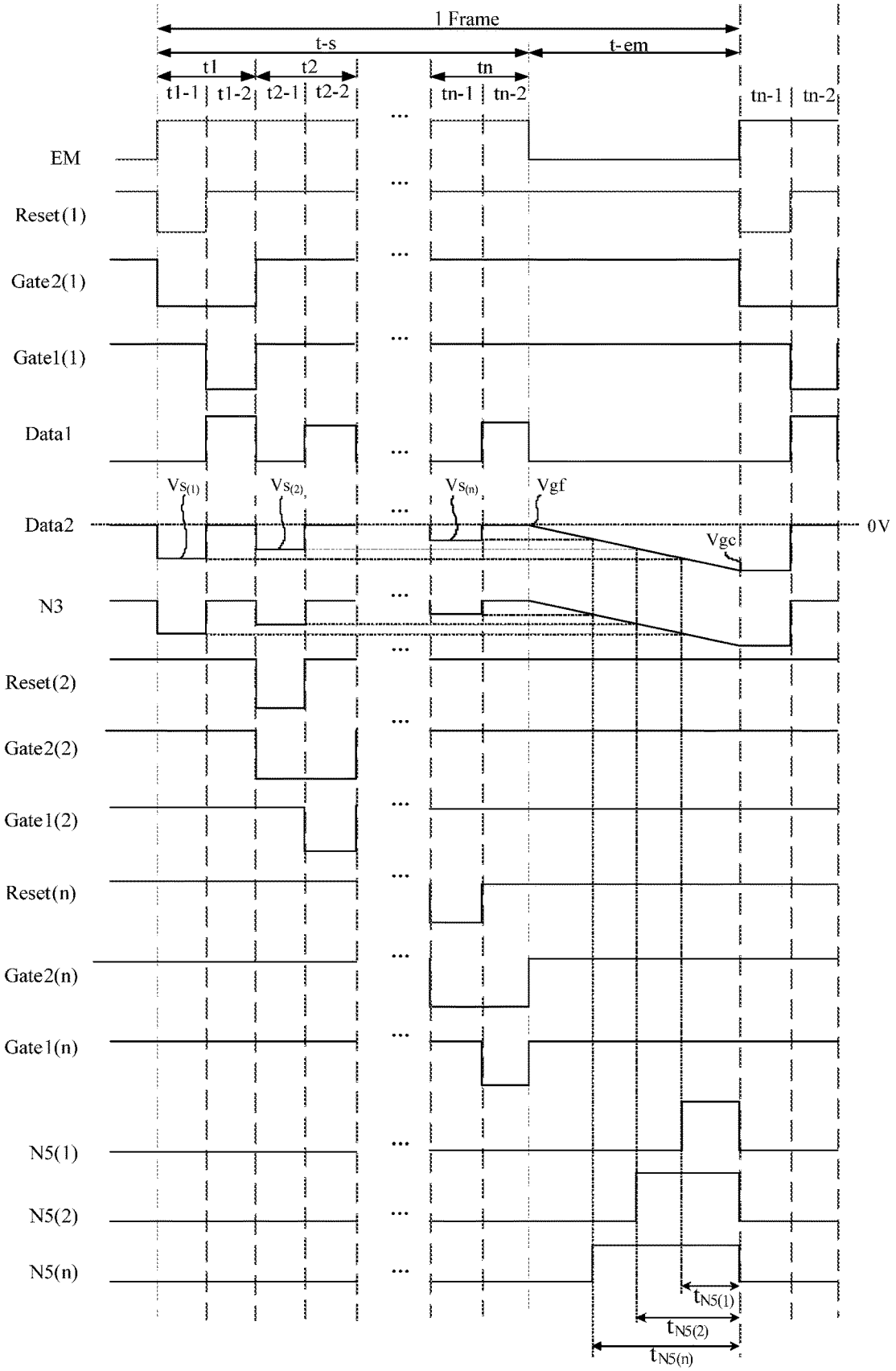
FIG. 6 is a timing diagram of a pixel driving method, according to some embodiments of the present disclosure.

Some embodiments of the present disclosure also provide a pixel driving method applied to the pixel driving circuit 100. As shown in FIG. 6, the pixel driving method includes one frame period (1 Frame) including a scanning stage t-s and a working stage t-em. The scanning stage t-s includes a plurality of row scanning periods. For example, the plurality of row scanning periods are n row scanning periods (n is greater than or equal to 2), and the n row scanning periods are a row scanning period t1 to a row scanning period tn.

Each of the plurality of row scanning periods (t1 to tn) includes: writing the first data signal Data1 into the driving signal control sub-circuit 1 under the control of the first scanning signal Gate1 transmitted via the first scanning signal terminal GATE1; and writing the second data signal Data2 having the given working potential into the driving duration control sub-circuit 2 under the control of the second scanning signal Gate2 transmitted via the second scanning signal terminal GATE2.

With reference to FIG. 2B, in a case where the driving signal control sub-circuit 1 includes the first data writing unit 11, the first driving unit 12 and the first control unit 13, the first data writing unit 11 writes the first data signal Data1 received at the first data signal terminal DATA1 to the first driving unit 12 under the control of the first scanning signal Gate1 transmitted via the first scanning signal terminal GATE1.

For example, as shown in FIG. 3B, the first data writing unit 11 includes the first transistor M1 and the second transistor M2, the first driving unit 12 includes the first storage capacitor C1 and the third transistor M3, and the first control unit 13 includes the fourth transistor M4 and the fifth transistor M5.

In this case, in each row scanning period, the first transistor M1 is turned on under the control of the first scanning signal Gate1, and transmits the first data signal Data1 received at the first data signal terminal DATA1 to the first end of the first storage capacitor C1 the potential at the first end of the first storage capacitor C1 is the potential of the first data signal Data1.

The second transistor M2 is turned on under the control of the first scanning signal Gate1, and the control electrode of the third transistor M3 is connected to the second electrode thereof, so that the third transistor M3 is in a self-saturation state. In this case, the voltage of the control electrode of the third transistor M3 is a sum of the voltage of the first electrode and a threshold voltage thereof. The first electrode of the third transistor M3 is connected to the third voltage signal terminal VREF, and thus the potential at the first electrode of the third transistor M3 is the potential of the third voltage signal Vref. In this case, the potential at the control electrode of the third transistor M3 is a sum of the potential of the third voltage signal Vref and the threshold voltage of the third transistor M3.

The potential at the second end of the first storage capacitor C1 is the same as the potential at the control electrode of the third transistor M3, and the potential at the second end of the first storage capacitor C1 is a sum of the potential of the third voltage signal Vref and the threshold voltage of the third transistor M3. In this case, there is a potential difference between the first end and the second end of the first storage capacitor C1, so that the first storage capacitor C1 is charged.

With reference to FIG. 2B, in a case where the driving duration control sub-circuit 2 includes the second data writing unit 21, the second control unit 23 and the second driving unit 22, the second data writing unit 21 writes the second data signal Data2 received at the second data signal terminal DATA2 into the second driving unit 22 under the control of the second scanning signal Gate2 transmitted via the second scanning signal terminal GATE2. The second data signal Data2 has a given working potential, and the given working potential is related to the working duration of the element 3 to be driven, and is determined by the working duration of the element 3 to be driven.

For example, as shown in FIG. 3B, the second data writing unit 21 includes the eighth transistor M8, the second control unit 23 includes the ninth transistor M9 and the tenth transistor M10, and the second driving unit 22 includes the second storage capacitor C2 and the eleventh transistor M11.

In this case, in each row scanning period, the eighth transistor M8 is turned on under the control of the second scanning signal Gate2 to transmit the second data signal Data2 to the first end of the second storage capacitor C2, and the potential at the first end of the second storage capacitor C2 is the given working potential of the second data signal Data2. As a result, the second storage capacitor C2 is charged.

In the entire scanning stage t-s, each of the n row scanning periods includes the above steps. In this way, the scanning of n rows of sub-pixels is realized, and the writing of the first data signal Data1 and the second data signal Data2 of the n rows of sub-pixels is completed. In addition, the storage of the first data signal Data1 and the second data signal Data2 is prepared for the output of the driving signal in the working stage t-em.

The working stage t-em includes: providing, by the driving signal control sub-circuit 1, a driving signal to the driving duration control sub-circuit 2 under the control of the enable signal Em transmitted via the enable signal terminal EM, and the driving signal is related to the first data signal Data1 and the first voltage signal Vdd provided via the first voltage signal terminal VDD; under the control of the enable signal Em transmitted via the enable signal terminal EM, receiving, by the driving duration control sub-circuit 2, the second data signal Data2 having the potential changing within the given range and transmitting, by the driving duration control sub-circuit, the driving signal to the element 3 to be driven, and the duration for transmitting the driving signal to the element 3 to be driven is related to the second data signal Data2 having the given working potential and the second data signal Data2 having the potential changing within the given range.

With reference to FIG. 2B, in a case where the driving signal control sub-circuit 1 includes the first data writing unit 11, the first driving unit 12 and the first control unit 13, the first control unit 13 transmits the driving signal to the driving duration control sub-circuit 2 under the control of the enable signal Em transmitted via the enable signal terminal EM.

For example, as shown in FIG. 3B, the first data writing unit 11 includes the first transistor M1 and the second transistor M2, the first driving unit 12 includes the first storage capacitor C1 and the third transistor M3, and the first control unit 13 includes the fourth transistor M4 and the fifth transistor M5.

In this case, in the working stage t-em, the fourth transistor M4 is turned on under the control of the enable signal Em transmitted via the enable signal terminal EM to transmit the first voltage signal received at the first voltage signal terminal VDD to the first end of the first storage capacitor C1, and the potential at the first end of the first storage capacitor C1 becomes the potential of the first voltage signal Vdd.

According to the law of conservation of charge of the capacitor, the potential difference between the first end and the second end of the first storage capacitor C1 remains unchanged. Since the potential at the first end of the first storage capacitor C1 jumps from the potential of the first data signal Data1 to the potential of the first voltage signal Vdd, the potential at the second end of the first storage capacitor C1 will also jump accordingly.

The third transistor M3 is turned on and generates a driving current, and the driving current is output from the second electrode of the third transistor M3. The fifth transistor M5 is turned on under the control of the enable signal Em transmitted via the enable signal terminal EM to transmit the driving signal to the driving duration control sub-circuit 2. That is, the driving current generated by the third transistor M3 is transmitted to the driving duration control sub-circuit 2 through the fifth transistor M5.

With reference to FIG. 2B, in a case where the driving duration control sub-circuit 2 includes the second data writing unit 21, the second control unit 23 and the second driving unit 22, the second control unit 23 writes the second data signal Data2 having the potential changing within the given range into the second driving unit 22 under the control of the enable signal Em transmitted via the enable signal terminal EM. The voltage of the second data signal Data2 changes within a given range. In a case where the voltage of the second data signal Data2 changes to a specific voltage value, the second driving unit 22 transmits the driving signal to the second control unit 23. The driving signal is then transmitted to the element 3 to be driven through the second control unit 23, and the element 3 to be driven starts to operate. The specific voltage value is related to the given working potential.

For example, as shown in FIG. 3B, the second data writing unit 21 includes the eighth transistor M8, the second control unit 23 includes the ninth transistor M9 and the tenth transistor M10, and the second driving unit 22 includes the second storage capacitor C2 and the eleventh transistor M11. In this case, in the working stage, the ninth transistor M9 is turned on under the control of the enable signal Em transmitted via the enable signal terminal EM to transmit the second data signal having the potential changing within the given range to the first end of the second storage capacitor C2. The potential at the first end of the second storage capacitor C2 is the potential of the second data signal Data2, and the potential changes within the given range.

According to the law of conservation of charge of the capacitor, in order to keep a potential difference between the first end and the second end of the second storage capacitor C2 unchanged, when the potential at the first end of the second storage capacitor C2 changes, the potential at the second end of the second storage capacitor C2 also changes accordingly. The potential at the control electrode of the eleventh transistor M11 is the same as the potential at the second end of the second storage capacitor C2, so that the potential at the control electrode of the eleventh transistor M11 also changes. When an absolute value of a gate-source voltage difference of the eleventh transistor M11 (a potential difference between the control electrode and the first electrode thereof) is greater than a threshold voltage thereof, the eleventh transistor M11 is turned on to transmit the driving signal to the first electrode of the tenth transistor M10.

The tenth transistor M10 is turned on under the control of the enable signal Em transmitted via the enable signal terminal EM to transmit the driving signal to the element 3 to be driven, so that the element 3 to be driven starts to work.

In the above pixel driving method, in one frame period (1 Frame), during the scanning stage t-s, the writing of the first data signals Data1 and the second data signals Data2 of each row of sub-pixels is realized. During the working stage t-em, the driving signal is generated, the driving signal is output, and the duration for transmitting the driving signal to the element 3 to be driven is controlled. In this way, the element 3 to be driven is controlled by controlling the magnitude of the driving signal and the working duration of the element 3 to be driven.

In some embodiments, the element to be driven 3 is a light-emitting device. The pixel driving method described above is used to change the luminous intensity of the light-emitting device by controlling the magnitude of the driving current and the light-emitting duration of the light-emitting device, thereby achieving a display of a corresponding gray scale. In a case where a high gray scale is displayed, the luminous intensity of the light-emitting device is increased by increasing the driving current input to the light-emitting device; and in a case where a low gray scale is displayed, the luminous intensity of the light-emitting device is reduced by shortening the working duration of the light-emitting device without a need to reduce the driving current input to the light-emitting device. In this way, the driving current transmitted to the light-emitting device is always large, and the light-emitting device is always at a high current density. As a result, the luminous efficiency is high, and the power consumption and the costs are reduced.

In some embodiments, the pixel driving method further includes: in each row scanning period, resetting, by the first reset unit 14, the voltage of the first driving unit 12 under the control of the reset signal Reset transmitted via the reset signal terminal RESET; and resetting, by the second reset unit 24, the voltage of the second driving unit 22 under the control of the reset signal Reset transmitted via the reset signal terminal RESET.

For example, as shown in FIGS. 5A and 5B, in a case where the first reset unit 14 includes the sixth transistor M6 and the seventh transistor M7, the sixth transistor M6 is turned on under the control of the reset signal Reset to transmit the first voltage signal Vdd to the first driving unit 12, and the seventh transistor M7 is turned on under the control of the reset signal Reset to transmit the initialization signal Vinit to the first driving unit 12, and thus the voltage of the first driving unit 12 is reset.

In a case where the second reset unit 24 includes the twelfth transistor M12 and the thirteenth transistor M13, the thirteenth transistor M13 is turned on under the control of the reset signal Reset transmitted via the reset signal terminal RESET, and the twelfth transistor M12 is turned on under the control of the reset signal Reset to transmit the initialization signal Vinit to the second driving unit 22, and thus the voltage of the second driving unit 22 is reset.

In the above embodiment, in each row scanning period, the voltage of the first driving unit 12 is reset through the first reset unit 14, and the voltage of the second driving unit 22 is reset through the second reset unit 24, so as to reduce noises of the signals at the first driving unit 12 and the second driving unit 22. As a result, the first data signal Data1 input to the first driving unit 12 and the second data signal Data2 input to the second driving unit 22 are free from interference and more accurate.

In some embodiments, the absolute value of the given working potential is related to the working duration of the corresponding element 3 to be driven. The absolute value of the given working potential of the second data signal Data2 written into each pixel driving circuit 100 is related to the working duration of the element 3 to be driven which is driven by the pixel driving circuit 100. In a case where the element 3 to be driven is a light-emitting device, the absolute value of the given working potential of the second data signal Data2 written into each pixel driving circuit 100 is related to the light-emitting duration of the light-emitting device corresponding to the pixel driving circuit 100. The light-emitting duration of the light-emitting device may be controlled by changing the absolute value of the given working potential, thereby achieving control of the gray scales of the sub-pixel.

On this basis, the pixel driving method provided by the embodiments of the present disclosure will be described below integrally and exemplarily. The following description will be made by taking the pixel driving circuit 100 shown in FIG. 5A as an example in conjunction with a timing signal diagram shown in FIG. 6. The pixel driving circuit 100 includes the first transistor M1, the second transistor M2, the third transistor M3, the fourth transistor M4, the fifth transistor M5, the sixth transistor M6, the seventh transistor M7, the eighth transistor M8, the ninth transistor M9, the tenth transistor M10, the eleventh transistor M11, the twelfth transistor M12, the thirteenth transistor M13, the first storage capacitor C1, the second storage capacitor C2 and the voltage stabilizing storage capacitor C3. In addition, the above transistors are all P-type transistors, and the element 3 to be driven includes the light-emitting diode 31.

As shown in FIG. 6, the pixel driving method includes a frame period (1 Frame) including a scanning stage t-s and a working stage t-em. The scanning stage t-s includes a plurality of row scanning periods t1 to tn, and each of the plurality of row scanning periods t1 to tn includes a first sub-period and a second sub-period. For example, a first row scanning period t1 includes a first sub-period t1-1 and a second sub-period t1-2, a second row scanning period t2 includes a first sub-period t2-1 and a second sub-period t2-2, and by analogy, an n-th row scanning period tn includes a first sub-period tn-1 and a second sub-period tn-2.

It will be noted that, in a case where the display device includes n rows and m columns of sub-pixels, and each sub-pixel corresponds to one pixel driving circuit 100, in the scanning stage t-s, the sub-pixels in the first row to the n-th row are scanned row by row, and the first data signals data1 and different second data signals data2 are written into the pixel driving circuits 100 corresponding to each row of the sub-pixels in sequence. After the sub-pixels in the first row to the n-th row are scanned row by row, the working stage t-em is started. In the working stage t-em, the pixel driving circuits 100 corresponding to the n rows and m columns of sub-pixels simultaneously receive the same second data signals data2. The potential of the second data signal data2 written into the pixel driving circuit 100 corresponding to each sub-pixel changes within a given range.

In each row scanning period, different first data signals data1 are simultaneously written into m pixel driving circuits 100 corresponding to m sub-pixels in a same row, that is, the first data signals data1 are a group of signals; and different second data signals data2 are simultaneously written into the m pixel driving circuits 100 corresponding to the m sub-pixels in the same row, that is, the second data signals data2 are a group of signals. The first data signals data1 and the second data signals data2 written into the m pixel driving circuits 100 corresponding to the m sub-pixels in the same row are related to the gray scales that the corresponding sub-pixels need to display. The pixel driving circuits 100 corresponding to the sub-pixels in the first column are taken as an example for description.

In the scanning stage t-s, a potential of the first data signal data1 transmitted via the first data signal terminal DATA1 is referred to as V1. A potential of the first data signal data1 is $V1_{(1)}$ in the first row scanning period t1, a potential of the first data signal data1 is $V1_{(2)}$ in the second row scanning period t2, and by analogy, a potential of the first data signal data1 is $V1_{(n)}$ in the n-th row scanning period tn.

In the first sub-period of each row scanning period, a potential of the second data signal data2 transmitted via the second data signal terminal DATA2 is referred to as a given working potential Vs. A given working potential of the second data signal data2 is $Vs_{(1)}$ in the first sub-period t1-1 of the first row scanning period t1, a given working potential of the second data signal data2 is $Vs_{(2)}$ in the first sub-period t2-1 of the second row scanning period t2, and by analogy, a potential of the second data signal data2 is $Vs_{(n)}$ in the first sub-period tn-1 of the second row scanning period tn.

A potential of the second data signal data2 transmitted via the second data signal terminal DATA2 is referred to as Vs' in the second sub-period of each row scanning period.

A potential of the second data signal data2 transmitted via the second data signal terminal DATA2 is referred to as Vg in the working stage t-em, and the potential Vg changes within a given range. The potentials Vg of the written second data signals change within a given range from the first row to the n-th row, and the given range corresponding to each row is the same.

In the first row scanning period t1 of the scanning stage t-s, a pixel driving circuit corresponding to the first sub-pixel in the first row includes the following driving process in the first sub-period t1-1 of the first row scanning period t1.

The reset signal Reset transmitted via the reset signal terminal RESET and the second scanning signal Gate2 transmitted via the second scanning signal terminal GATE2 are low level signals. The first scanning signal Gate1 transmitted via the first scanning signal terminal GATE1 and the enable signal Em transmitted via the enable signal terminal EM are high level signals. The sixth transistor M6, the seventh transistor M7, the twelfth transistor M12 and the thirteenth transistor M13 are turned on under the control of the reset signal Reset, the eighth transistor M8 is turned on under the control of the second scanning signal Gate2, and the remaining transistors are all turned off.

The sixth transistor M6 transmits the first voltage signal Vdd received at the first voltage signal terminal VDD to the first end of the first storage capacitor C1. In this case, the potential at the first end of the first storage capacitor C1 (the potential at the first node N1) is a potential Vd of the first voltage signal Vdd.

The seventh transistor M7 transmits the initialization signal Vinit received at the initialization signal terminal VINIT to the second end of the first storage capacitor C1. In this case, the potential at the second end of the first storage capacitor C1 (the potential t the second node N2) is the potential of the initialization signal Vinit. For example, the potential of the initialization signal Vinit is 0 V.

The eighth transistor M8 transmits the second data signal Data2 received at the second data signal terminal DATA2 to the first end of the second storage capacitor C2. In this case, the potential at the first end of the second storage capacitor C2 (the potential t the third node N3) is the same as the potential of the second data signal Data2, which is the given working potential $Vs_{(1)}$.

The twelfth transistor M12 transmits the initialization signal Vinit received at the initialization signal terminal VINIT to the first electrode of the eleventh transistor M11, and the potential at the first electrode of the eleventh transistor M11 is the potential of the initialization signal Vinit; the thirteenth transistor M13 is turned on, and the control electrode of the eleventh transistor M11 is connected to the second electrode thereof, so that the eleventh transistor M11 is in a self-saturation state. In this case, the potential at the control electrode of the eleventh transistor M11 is a sum of the potential at the first electrode thereof (the potential of the initialization signal Vinit) and a threshold voltage Vth2 thereof. For example, the potential of the initialization signal Vinit is 0 V, the potential at the control electrode of the eleventh transistor M11 is Vth2, and the potential at the second end of the second storage capacitor C2 (the potential at the fourth node N4) is also Vth2.

In the first row scanning period t1 of the scanning stage t-s, a pixel driving circuit corresponding to the first sub-pixel in the first row includes the following driving process in the second sub-period t1-2 of the first row scanning period t1.

The first scanning signal Gate1 transmitted via the first scanning signal terminal GATE1 and the second scanning signal Gate2 transmitted via the second scanning signal terminal GATE2 are low level signals. The reset signal Reset transmitted via the reset signal terminal RESET and the enable signal Em transmitted via the enable signal terminal EM are high level signals. The first transistor M1 and the second transistor M2 are turned on under the control of the first scanning signal Gate1, the eighth transistor M8 is turned on under the control of the second scanning signal Gate2, and the remaining transistors are all turned off.

The first transistor M1 transmits the first data voltage Data1 received at the first data signal terminal DATA1 to the first end of the first storage capacitor C1. In this case, the potential at the first end of the first storage capacitor C1 (the potential at the first node N1) is the potential $V1_{(1)}$ of the first data signal Data1.

The second transistor M2 is turned on, and the control electrode of the third transistor M3 is connected to the second electrode thereof, so that the third transistor M3 is in a self-saturation state. The potential at the control electrode of the third transistor M3 is a sum of the potential at the first electrode of the third transistor M3 and a threshold voltage Vth1 thereof. The potential at the first electrode of the third transistor M3 is a potential Vre of the third potential signal Vref, the potential at the control electrode of the third transistor M3 is Vre plus Vth1 (Vre+Vth1), and the potential at the second end of the first storage capacitor C1 (the potential at the second node N2) is also Vre plus Vth1 (Vre+Vth1).

The eighth transistor M8 transmits the second data signal Data2 received at the second data signal terminal DATA2 to the first end of the second storage capacitor C2. In this case, the potential at the first end of the second storage capacitor C2 (the potential at the third node N3) is the same as the potential Vs' of the second data signal Data2. For example, in this case, the potential Vs' of the second data signal is 0 V.

In the first sub-period t1-1, the potential at the first end of the second storage capacitor C2 is the given working potential $Vs_{(1)}$, and the potential at the second end of the second storage capacitor C2 is Vth2. According to the law of conservation of charge of the capacitor, the potential difference between the first end and the second end of the second storage capacitor C2 remains unchanged, then in the second sub-period t1-2, the potential at the first end of the second storage capacitor C2 jumps to 0 V, and the potential at the second end of the second storage capacitor C2 jumps to Vth2 minus $Vs_{(1)}$ ($Vth2-Vs_{(1)}$).

The driving process of the pixel driving circuits 100 corresponding to the sub-pixels in the second row to the driving process of the pixel driving circuits 100 corresponding to the sub-pixels in the n-th row each is consistent with the driving process of the pixel driving circuits 100 corresponding to the sub-pixels in the first row. In the scanning stage t-s, the illustration of the second row scanning period t2 to the illustration of the n-th row scanning period to each may refer to the illustration of the first row scanning period t1.

After the sub-pixels in the first row to the sub-pixels the n-th row are scanned row by row, each row of the sub-pixels of the display device enters the working stage t-em. The working stage t-em of the first sub-pixel in the first row includes the following process.

The enable signal Em transmitted via the enable signal terminal EM is a low level signal. The first scanning signal Gate1 transmitted via the first scanning signal terminal GATE1, the second scanning signal Gate2 transmitted via the second scanning signal terminal GATE2 and the reset signal Reset transmitted via the reset signal terminal RESET are high level signals. The fourth transistor M4, the fifth transistor M5, the ninth transistor M9 and the tenth transistor M10 are turned on under the control of the enable signal Em, and the remaining transistors are all turned off.

The fourth transistor M4 transmits the first voltage signal Vdd received at the first voltage signal terminal VDD to the first end of the first storage capacitor C1. In this case, the potential at the first end of the first storage capacitor C1 (the potential at the first node N1) is the potential Vd of the first voltage signal Vdd.

In the second sub-period t1-2 of the first row scanning period t1, the potential at the first end of the first storage capacitor C1 is the potential $V1_{(1)}$ of the first data signal Data1, and the potential at the second end of the first storage capacitor C1 is Vre plus Vth1 (Vd+Vth1). According to the law of conservation of charge of the capacitor, the potential difference between the first end and the second end of the first storage capacitor C1 remains unchanged, and then in the working stage t-em, the potential at the first end of the first storage capacitor C1 becomes Vd, and the potential at the second end of the first storage capacitor C1 becomes $Vd+Vre-V1_{(1)}+Vth\ 1$.

The third transistor M3 generates a driving current according to the first voltage signal Vdd and the potential at the second end of the second storage capacitor C2.

The fifth transistor M5 is turned on to transmit the driving current generated by the third transistor M3 to the first electrode of the eleventh transistor M11.

The ninth transistor M9 transmits the second data signal Data2 received at the second data signal terminal DATA2 to the first end of the second storage capacitor C2. In this case, the potential at the first end of the second storage capacitor C2 (the potential at the third node N3) is the potential Vg of the second data signal Data2, and the potential Vg of the second data signal Data2 changes within a given range.

In some embodiments, values of two ends of the given range are respectively a non-working potential Vgf and a reference working potential Vgc of the second data signal Data2. An absolute value of the reference working potential Vgc is greater than or equal to a maximum value of absolute values of all the given working potentials Vs of the second data signal Data2. The given working potential Vs is within the given range.

For example, the non-working potential Vgf of the second data signal Data2 is 0 V. In the working stage t-em, the potential Vg of the second data signal gradually changes from the non-working potential Vgf (0 V) to the reference working potential Vgc, and the potential at the first end of the second storage capacitor C2 (the potential at the third node N3) also gradually changes from the non-working potential Vgf (0vV) to the reference working potential Vgc.

According to the law of conservation of charge of the capacitor, the potential difference between the first end and the second end of the second storage capacitor C2 remains unchanged. In the second sub-period t1-2 of the first row scanning period t1, the potential t the first end of the second storage capacitor C2 is 0 V, and the potential at the second end of the second storage capacitor C2 is Vth2 minus $Vs_{(1)}$ ($Vth2-Vs_{(1)}$). The potential difference between the first end and the second end of the second storage capacitor C2 is $Vs_{(1)}$ minus Vth2 ($Vs_{(1)}-Vth2$), and then in the working stage t-em, the potential at the second end of the second storage capacitor C2 (the potential at the fourth node N4) gradually changes from $Vth2-Vs_{(1)}$ to $Vth2-Vs_{(1)}+Vgc$.

In the process of the change in the potential at the second end of the second storage capacitor C2, the potential at the control electrode of the eleventh transistor M11 (the potential at the fourth node N4) also gradually changes from $Vth2-Vs_{(1)}$ to $Vth2-Vs_{(1)}+Vgc$. In a case where the potential at the control electrode of the eleventh transistor M11 changes to a certain potential, the eleventh transistor M11 may be turned on, and this potential is set as a turn-on potential $V_k$. The turn-on potential $V_k$ meets the following conditions that: a gate-source voltage difference Vgs of the eleventh transistor M11 is a difference of $V_k$ and Vd(1) (i.e., $Vgs=V_k-Vd(1)$), where Vd(1) is a potential of the first voltage signal Vdd after passing through the third transistor M3. In a case where an absolute value of a gate voltage difference of the eleventh transistor M11 is greater than or equal to an absolute value of the threshold voltage Vth2 thereof, the eleventh transistor M11 is turned on. That is, in a case where the turn-on potential $V_k$ satisfies that $|V_k$ minus $Vd(1)|$ is greater than or equal to $|Vth2|$ (i.e., $|V_k-Vd(1)|\geq|Vth2|$), and $V_k$ is less than or equal to Vth2 plus Vd(1) (i.e., $V_k\leq Vth2+Vd(1)$), the eleventh transistor M11 is turned on to make the driving signal pass through. Before that, the eleventh transistor M11 is turned off, and the driving signal cannot pass through.

For example, with reference to FIG. 6, when the potential Vg of the second data signal Data2 changes from the non-working potential Vgf (0 V) to the given working potential $Vs_{(1)}$ in the first sub-period t1-1 of the first row scanning period t1, the potential at the first end of the second storage capacitor C2 is $Vs_{(1)}$, and the potential at the second end of the second storage capacitor C2 is Vth2. That is, the potential at the control electrode of the eleventh transistor M11 is Vth2. Since Vth2 is less than or equal to Vth2 plus Vd(1) (i.e., Vth2≤Vth2+Vd(1)), which meets the condition of the turn-on potential $V_k$, the eleventh transistor M11 is turned on. Generally, if the resistance of the third transistor M3 is ignored, Vd(1) is equal to 0 (i.e., Vd(1)=0). Therefore, it will be understood that, during a time period when the potential Vg of the second data signal Data2 changes from the given working potential $Vs_{(1)}$ to the reference working potential Vgc, the eleventh transistor M11 is kept in a turn-on state and transmits the driving signal to the tenth transistor M10 until the working stage ends.

The absolute value of the reference working potential Vgc is greater than or equal to the maximum value of the absolute values of all the given working potentials Vs of the second data signal Data2. For example, as shown in FIG. 6, with reference to the above description of the sub-pixels in the first row in the working stage t-em, the absolute value of the reference working potential Vgc is greater than the absolute value of the given working potential $Vs_{(1)}$ of the second data signal Data2 in the first sub-period t1-1 of the first row scanning period t1. In this way, during the working stage t-em, in the process that the potential Vg of the second data signal Data2 gradually changes from the non-working potential Vgf to the reference working potential Vgc, the eleventh transistor M11 can be turned on when the potential Vg of the second data signal Data2 reaches the turn-on potential $V_k$ (such as the given working potential $Vs_{(1)}$), so that the driving signal may be transmitted. Similarly, with respect to the sub-pixels in the second row to the sub-pixels in the n-th row, the absolute value of the reference working potential Vgc of the second data signal Data2 in the working stage t-em is greater than or equal to the absolute values of the given working potentials $Vs_{(2)}$, $Vs_{(3)}$ . . . $Vs_{(n)}$ of the second data signal Data2, so that the eleventh transistor M11 can be turned on.

During the period when the eleventh transistor M11 is turned on, the eleventh transistor M11 transmits the driving signal to the tenth transistor M10, and the tenth transistor M10 is turned on under the control of the enable signal Em to transmit the driving signal to the element 3 to be driven, so as to make the element 3 to be driven work.

Driving processes of the pixel driving circuits 100 corresponding to the sub-pixels in the second row to the sub-pixels in the n-th row in the working stage t-em may refer to the above descriptions of the driving process of the pixel driving circuits 100 corresponding to the sub-pixels in the first row in the working stage t-em.

In some embodiments, in the scanning stage t-s, the potentials V1 of the first data signals Data1 written into the pixel driving circuits 100 corresponding to each row of sub-pixels are related to the magnitudes of the driving signals generated by the pixel driving circuits 100 corresponding to this row of sub-pixels in the working stage t-em.

It can be seen from the above that in the working stage t-em, if the potential at the second end of the first storage capacitor C1 of the pixel driving circuit 100 corresponding to each row of sub-pixels is Vd+Vre−V1+Vth1, the potential at the control electrode of the third transistor is Vd+Vre−V1+Vth1. The potential at the first electrode of the third transistor is Vre, so that the gate-source voltage difference $V_{gs}$ of the third transistor M3 is (Vd+Vre−V1+Vth1) minus Vre, which is equal to Vd−V1+Vth1. As a result, in the working stage t-em, according to a current saturation formula, the driving current generated by the third transistor M3 is:

$$I_{ds} = \frac{W}{2L} \times \mu \times C_{ox}(V_{gs} - Vth1)^2 = \frac{W}{2L} \times \mu \times C_{ox}(Vd + Vre - V1 + Vth1 - Vre - Vth1)^2 = \frac{W}{2L} \times \mu \times C_{ox}(Vd - V1)^2$$

Where $I_{ds}$ is a saturation current of the third transistor M3, i.e., the working current input to the light-emitting diode 31; W/L is a channel width-to-length ratio of the third transistor M3; μ is the carrier mobility; $C_{ox}$ is a channel capacitance per unit area of the third transistor M3; $V_{gs}$ is the gate-source voltage difference of the third transistor M3; and Vth1 is the threshold voltage of the third transistor M3.

It can be seen that the driving current generated by the third transistor M3 is only related to the potential Vd of the first voltage signal Vdd and the potential V1 of the written first data signal Data1, and is independent of the threshold voltage Vth1 of the third transistor M3. As a result, the magnitude of the driving current generated by the third transistor M3 is not affected by the threshold voltage, which avoids affecting the driving current due to a difference in the threshold voltage of the third transistor M3 caused by the manufacturing process, and further affecting the display effect. In addition, the driving current generated by the third transistor M3 is independent of the potential of the third voltage signal Vref. As a result, the driving current generated by the third transistor M3 will not be affected by the voltage drop of the third voltage signal line, which avoids the phenomenon of the non-uniform display of the display panel which is caused by inconsistent third voltage signals Vref received by the pixel drive circuits 100 due to the voltage drop and inconsistent magnitudes of the generated driving signals.

By controlling the potentials $V1_{(1)}$ to $V1_{(n)}$ of the first data signals Data1 written into the pixel driving circuits 100 corresponding to each row of sub-pixels in the first row scanning period t1 to the n-th row scanning period tn, the magnitudes of the driving currents generated by the pixel driving circuits 100 in each row are controlled, thereby controlling the luminous intensity of the light-emitting diodes 31.

In some embodiments, in the first sub-period of each row scanning period, the absolute value of the given working potential Vs of the second data signal data2 is related to the working duration of the corresponding element 3 to be driven.

As shown in FIG. 6, in the first sub-period t1-1 of the first row scanning period t1, the given working potentials of the second data signals data2 written into the pixel driving circuits 100 corresponding to the sub-pixels in the first row is $Vs_{(1)}$; in the first sub-period t2-1 of the second row scanning period t2, the given working potentials of the second data signals data2 written into the pixel driving circuits 100 corresponding to the sub-pixels in the second row is $Vs_{(2)}$, . . . ; and in the first sub-period tn-1 of the n-th scanning period tn, the given working potentials of the second data signals data2 written into the pixel driving circuits 100 corresponding to the sub-pixels in the n-th row is $Vs_{(n)}$, wherein the absolute values of $Vs_{(1)}$, $Vs_{(2)}$ and $Vs_{(n)}$ are sequentially reduced in magnitude.

After the working stage t-em is started, the potentials of the second data signals data2 written into the pixel driving circuits 100 corresponding to each row of sub-pixels each changes within a given range. When the potential of the second data signal data2 changes from the non-working potential Vgf (0 V) to the given working potential Vs, the eleventh transistor M11 is turned on to transmit the driving signal to the element to be driven.

With continued reference to FIG. 6, in the working stage t-em, in the process that the potential of the second data signal data2 changes from the non-working potential Vgf (0 V) to the given working potential Vs, the smaller the absolute value of the given working potential Vs is, the shorter the duration required for the potential of the second data signal data2 to change from the non-working potential (0 V) to the given working potential Vs is. As a result, in the working stage t-em, the longer the duration that the eleventh transistor M11 is turned on, the longer the duration for transmitting the driving signal to the light-emitting diode 31, and therefore the longer the duration that the light-emitting diode 31 works in one frame period (1 Frame), the stronger the luminous intensity thereof.

For example, as shown in FIG. 5A, in a case where the anode of the light-emitting diode 31 is electrically connected to the second electrode of the tenth transistor M10 (a node where the two are electrically connected is equivalent to the fifth node N5), and the cathode of the light-emitting diode 31 is connected to the ground, the light-emitting diode 31 starts to emit light when the potential at the fifth node N5 is at a high level. It may be seen from FIG. 6 that absolute values of $Vs_{(1)}$, $Vs_{(2)}$ and $Vs_{(n)}$ decrease in sequence in magnitude, and light-emitting durations $t_{N5(1)}$, $t_{N5(2)}$, and $t_{N5(n)}$ of the corresponding light-emitting diodes 31 increase in sequence, thereby achieving a display of different gray scales.

In summary, the pixel driving method provided by the present disclosure may control the magnitude of the generated driving signal by controlling the potential of the first data signal Data1 written into the driving signal control sub-circuit in the scanning stage t-s, and may control the working duration of the element 3 to be driven by controlling the absolute value of the given working potential of the second data signal Data2 written into the driving duration control sub-circuit 2 in the scanning stage t-s, so that different gray scales may be displayed through cooperation of different driving signals and different working durations. In addition, the magnitude of the driving signal may be maintained in a high value range by shortening the working duration of the element to be driven, thereby improving the working efficiency of the element to be driven and saving energy consumption.

Furthermore, the control of the driving signal and the control of the working duration are independent of the threshold voltage of the transistor, which avoids affecting the display effect due to unstable threshold voltage of the transistor caused by process defects.

Some embodiments of the present disclosure further provide a display panel including the pixel driving circuit described above.

In a case where the display panel provided by the present disclosure adopts the above pixel driving circuit, and the element to be driven is a micro light-emitting diode, a combination of current control and light-emitting duration control is adopted according to characteristics that the micro light-emitting diode has a high luminous efficiency at a high current density and a low luminous efficiency at a low current density. In a case where the display of different gray scales is realized, the luminous intensity of the micro light-emitting diode is controlled by controlling the light-emitting duration of the micro light-emitting diode, and the current value input to the micro light-emitting diode is kept in a high range. Therefore, the micro light-emitting diode is always at a high current density, and the luminous efficiency is high, which reduces power consumption and saves the cost.

Figure 7:
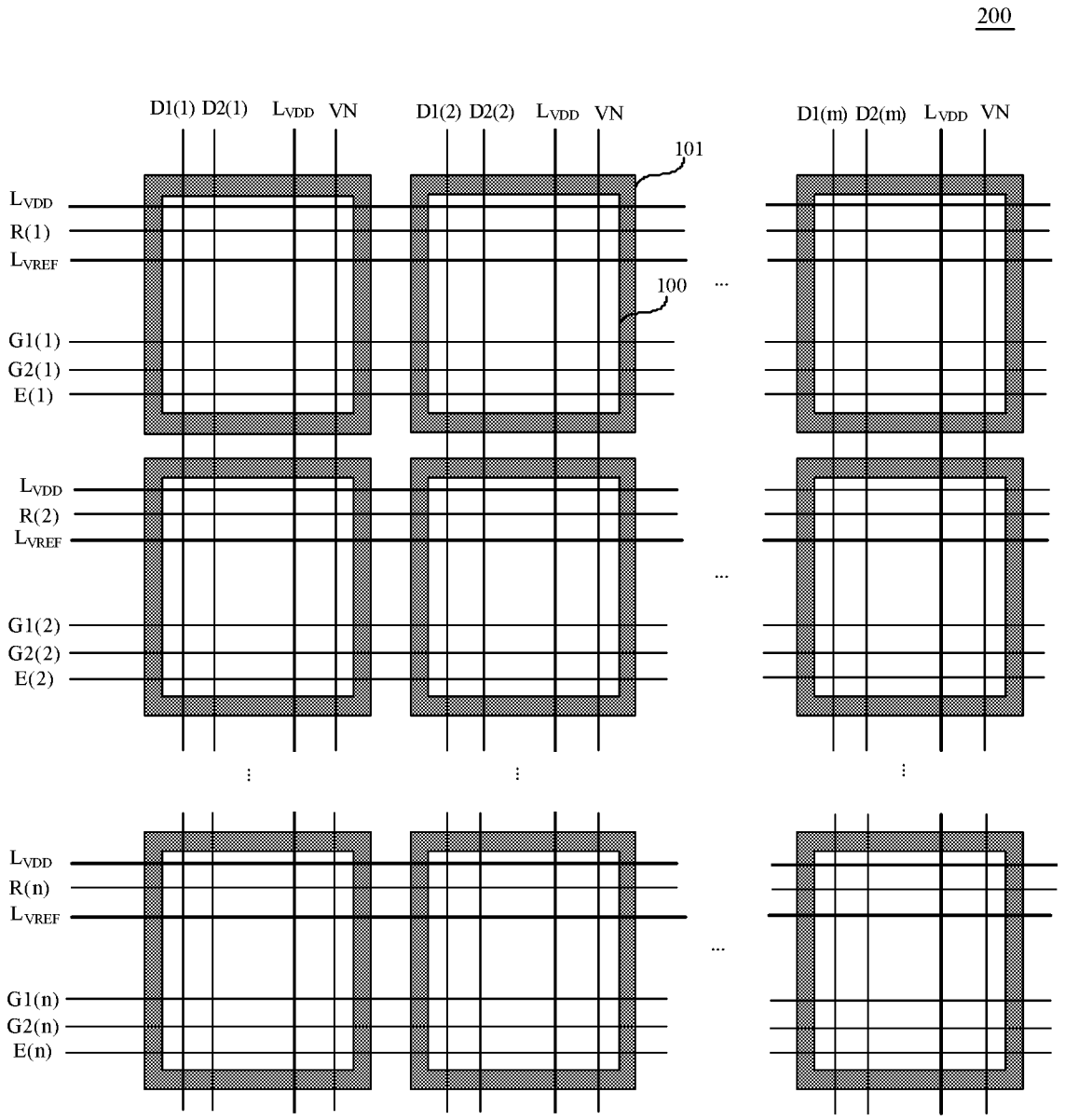
FIG. 7 is a schematic diagram showing a structure of a display panel, according to some embodiments of the present disclosure.

In some embodiments, as shown in FIG. 7, a display panel 200 includes a plurality of sub-pixels 101. Each sub-pixel 101 corresponds to a pixel driving circuit 100, and the plurality of sub-pixels 101 are arranged in an array of multiple rows and multiple columns. For example, the plurality of sub-pixels 101 are arranged in an array of n rows and m columns.

The display panel 200 further includes a plurality of first scanning signal lines G1(1) to G1(*n*), a plurality of first data signal lines D1(1) to D1(*m*), a plurality of second scanning signal lines G2(1) to G2(*n*), and a plurality of second data signal lines D2(1) to D2(*m*).

Pixel driving circuits 100 corresponding to sub-pixels 101 in a same row are electrically connected to a same first scanning signal line and a same second scanning signal line. Pixel driving circuits 100 corresponding to sub-pixels 101 in a same column are electrically connected to a same first data signal line and a same second data signal line. For example, the pixel driving circuits 100 corresponding to the first row of sub-pixels 101 are electrically connected to the first scanning signal line G1(1) and the second scanning signal line G2(1), and the pixel driving circuits 100 corresponding to the first column of sub-pixels 101 are electrically connected to the first data signal line D1(1) and the second data signal line D2(1).

In this way, the plurality of first scanning signal lines provide the first scanning signal terminals GATE1 with the first scanning signals Gate1; the plurality of second scanning signal lines provide the second scanning signal terminals GATE2 with the second scanning signals Gate2; the plurality of first data signal lines provide the first data signal terminals DATA1 with the first data signals Data1; and the plurality of second data signal lines provide the second data signal terminals DATA2 with the second data signals Data2. As a result, the pixel driving circuits 100 are provided with the first scanning signals Gate1, the second scanning signals Gate2, the first data signals Data1 and the second data signals Data2.

The display panel 200 further includes: a plurality of reset signal lines R(1) to R(n), a plurality of enable signal lines E1(1) to E1(*n*), a plurality of initialization signal lines VN, a plurality of first voltage signal lines $L_{VDD}$ and a plurality of third voltage signal lines $L_{VREF}$.

The pixel driving circuits 100 corresponding to the sub-pixels 101 in the same row are electrically connected to a same reset signal line, a same enable signal line and a same third voltage signal lines $L_{VREF}$. The pixel driving circuits 100 corresponding to the sub-pixels 101 in the same column are electrically connected to a same initialization signal line.

The plurality of first voltage signal lines $L_{VDD}$ are arranged in a grid shape along a row direction and along a column direction, and the pixel driving circuits 100 corresponding to the sub-pixels 101 in the same column are electrically connected to a same first voltage signal line $L_{VDD}$ arranged in the column direction. The plurality of first voltage signal lines $L_{VDD}$ arranged along the row direction are electrically connected to the plurality of first voltage signal lines $L_{VDD}$ arranged along the column direction respectively. The plurality of first voltage signal lines $L_{VDD}$ arranged along the row direction are configured to reduce the resistance of the plurality of first voltage signal lines $L_{VDD}$ arranged along the column direction, so as to reduce the RC load and the IR drop of the first voltage signal Vdd.

In this way, the plurality of reset signal lines provide the reset signals Reset for the reset signal terminals RESET; the plurality of enable signal lines provide the enable signals Em for the enable signal terminals EM; the plurality of initialization signal lines provide the initialization signals Vinit for the initialization signal terminals VINIT; the plurality of third voltage signal lines $L_{VREF}$ provide the third voltage signals Vref for the third voltage signal terminals VREF; and the plurality of first voltage signal lines arranged along the column direction provide the first voltage signals Vdd for the first voltage signal terminals VDD. As a result, the pixel driving circuits 100 are provided with the reset signals Reset, the enable signals Em, the initialization signals Vinit, the first voltage signals Vdd, and the third voltage signals Vref. The first voltage signal Vdd and the third voltage signal Vref are both high-level constant voltage signals, and their amplitudes may be the same or different.

It will be noted that, the arrangement of the plurality of signal lines included in the display panel 200 and the wiring diagram of the display panel 200 shown in FIG. 7 are only an example, and the structure of the display panel is not limited thereto.

In some embodiments, the display panel 200 further includes: a base substrate on which the pixel driving circuit is disposed. The base substrate is a glass substrate.

In some embodiments, the display panel is a micro light-emitting diode display panel, and each of the plurality of sub-pixels included in the display panel corresponds to at least one micro light-emitting diode.

Since the micro light-emitting diode has the characteristics of high luminous efficiency at the high current density and low luminous efficiency at the low current density, the pixel driving circuit 100 provided by the present disclosure adopts the combination of the current control and the light-emitting duration control to realize the display of different gray scales. In a case where a low gray scale is displayed, the current input to the micro light-emitting diode is kept in a high range by shortening the light-emitting duration of the micro light-emitting diode, so that the micro light-emitting diode is always at a high current density and has a high luminous efficiency. Furthermore, the power consumption of the display panel is reduced, and the cost is saved, so that the display panel provided by the present disclosure can be applied to an active driving method.

The display panel provided by the present disclosure adopts the active driving method, and the pixel driving circuit 100 may be disposed on a base substrate made of glass. Due to a fact that the splicing process of the glass substrate is mature, the display panel may be spliced according to the required display size to obtain a display panel with a large display size suitable for being watched at a medium distance. For example, the display panel is a television screen. Moreover, since the display panel adopts the active driving method and adopts the glass substrate as the base substrate, manufacturing processes with high precision (such as exposure, development and etching) may be adopted to manufacture the pixel driving circuit, so that the precision of the obtained pixel driving circuit 100 is high, and the size of the sub-pixels may be reduced. For example, the size of the sub-pixel may be 400 μm or even smaller. As a result, the resolution of the display panel is improved, and the image quality of the display image is fine. In a case where the display panel is a Micro LED display panel, the color gamut and brightness of the display panel may be improved, and the HDR display may be realized, thereby improving the display effect of the display image of the display panel.

In some embodiments, the transistors in the pixel driving circuit 100 included in the display panel 200 are manufactured on the glass substrate by using a low temperature poly-silicon (LTPS) process. Since the low-temperature poly-silicon has the characteristics of high mobility and good stability, the response speeds of the manufactured transistors may be improved. Thus, the LTPS process is more suitable for the pixel driving circuit 100 that is provided by the present disclosure and is controlled by the driving current and the driving duration. In addition, since the compensation of the threshold voltages of the third transistor M3 and the eleventh transistor M11 has been made in the driving method of the pixel driving circuit 100, the display effect of the display panel 200 will not be affected by the threshold voltage shift of the transistors due to the defects of the LTPS process.

Figure 8:
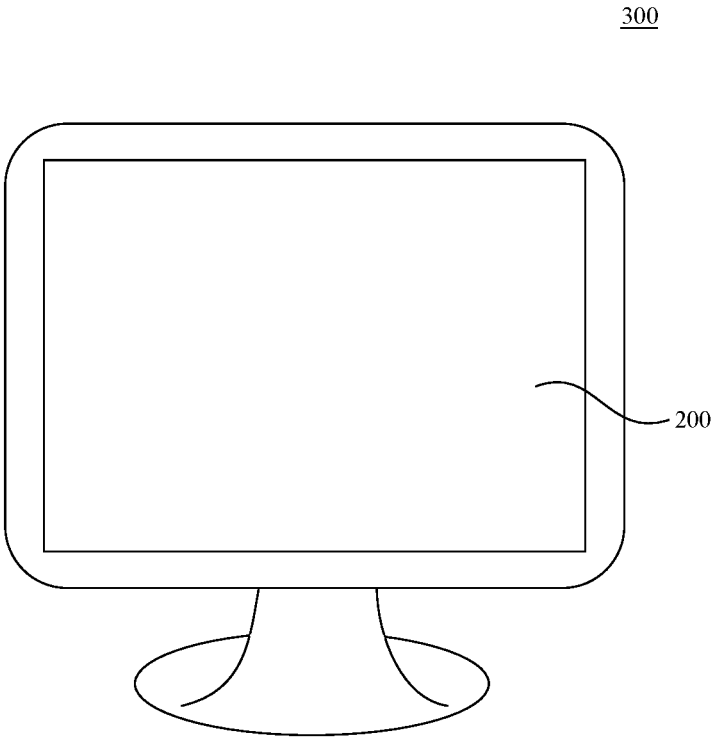
FIG. 8 is a schematic diagram of a display device, according to some embodiments of the present disclosure.

As shown in FIG. 8, some embodiments of the present disclosure further provide a display device 300 including the display panel 200.

The display device 300 provided by the present disclosure includes the display panel 200, therefore, the display device 300 has the characteristics of large display size, high pixel resolution, being suitable for HDR display, and good display effect.

In some examples, the display device 300 is a product with a display function such as a television, a cellphone, a tablet computer, a notebook computer, a display, a digital photo frame or a navigator, which is not limited in the present disclosure.

The foregoing descriptions are merely specific implementation manners of the present disclosure, but the protection scope of the present disclosure is not limited thereto. Any person skilled in the art could conceive of changes or replacements within the technical scope of the present disclosure, which shall all be included in the protection scope of the present disclosure. Therefore, the protection scope of the present disclosure shall be subject to the protection scope of the claims.

What is claimed is:

1. A pixel driving circuit, comprising a driving signal control sub-circuit, a driving duration control sub-circuit, a first scanning signal terminal, a first data signal terminal, a first voltage signal terminal, an enable signal terminal, a second scanning signal terminal, a second data signal terminal and an element to be driven; wherein the driving signal control sub-circuit is electrically connected to the first scanning signal terminal, the first data signal terminal, the first voltage signal terminal, the enable signal terminal and the driving duration control sub-circuit, and is configured to provide a driving signal to the driving duration control sub-circuit under control of a first scanning signal transmitted via the first scanning signal terminal and an enable signal transmitted via the enable signal terminal; and the driving signal is related to a first data signal received at the first data signal terminal and a first voltage signal received at the first voltage signal terminal; and the driving duration control sub-circuit is electrically connected to the second scanning signal terminal, the second data signal terminal, the enable signal terminal and the element to be driven, and is configured to transmit the driving signal to the element to be driven under control of a second scanning signal transmitted via the second scanning signal terminal and the enable signal transmitted via the enable signal terminal; and a duration for transmitting the driving signal to the element to be driven is related to a second data signal received at the second data signal terminal.

2. The pixel driving circuit according to claim 1, further comprising a third voltage signal terminal, wherein the driving signal control sub-circuit includes a first data writing unit, a first driving unit and a first control unit; wherein the first data writing unit is electrically connected to the first scanning signal terminal, the first data signal terminal and the first driving unit, and is configured to write the first data signal received at the first data signal terminal into the first driving unit under the control of the first scanning signal transmitted via the first scanning signal terminal;

the first control unit is electrically connected to the enable signal terminal, the first voltage signal terminal and the first driving unit, and is configured to input the first voltage signal received at the first voltage signal terminal to the first driving unit under the control of the enable signal transmitted via the enable signal terminal;

the first driving unit is electrically connected to the third voltage signal terminal, and is configured to generate a driving signal according to the written first data signal, the input first voltage signal and a third voltage signal received at the third voltage signal terminal, and transmit the driving signal to the first control unit; and the first control unit is electrically connected to the driving duration control sub-circuit, and is configured to transmit the driving signal to the driving duration control sub-circuit under the control of the enable signal transmitted via the enable signal terminal.

3. The pixel driving circuit according to claim 2, wherein the first data writing unit includes:

a first transistor, a control electrode of the first transistor is electrically connected to the first scanning signal terminal, a first electrode of the first transistor is electrically connected to the first data signal terminal, and a second electrode of the first transistor is electrically connected to the first driving unit; and a second transistor, a control electrode of the second transistor is electrically connected to the first scanning signal terminal, and a first electrode and a second electrode of the second transistor are electrically connected to the first driving unit;

the first driving unit includes:

a first storage capacitor, a first end of the first storage capacitor is electrically connected to the first data writing unit and the first control unit, and a second end of the first storage capacitor is electrically connected to the first data writing unit; and a third transistor, a control electrode of the third transistor is electrically connected to the second end of the first storage capacitor and the first data writing unit, a first electrode of the third transistor is electrically connected to the third voltage signal terminal, and a second electrode of the third transistor is electrically connected to the first data writing unit and the first control unit; and the first control unit includes:

a fourth transistor, a control electrode of the fourth transistor is electrically connected to the enable signal terminal, a first electrode of the fourth transistor is electrically connected to the first voltage signal terminal, and a second electrode of the fourth transistor is electrically connected to the first driving unit; and a fifth transistor, a control electrode of the fifth transistor is electrically connected to the enable signal terminal, a first electrode of the fifth transistor is electrically connected to the first driving unit, and a second electrode of the fifth transistor is electrically connected to the driving duration control sub-circuit.

4. The pixel driving circuit according to claim 2, wherein the driving signal control sub-circuit further includes a first reset unit, a reset signal terminal and an initialization signal terminal; and the first reset unit is electrically connected to the first voltage signal terminal, the reset signal terminal, the initialization signal terminal and the first driving unit, and is configured to reset a voltage of the first driving unit according to the first voltage signal received at the first voltage signal terminal and an initialization signal received at the initialization signal terminal under control of a reset signal transmitted via the reset signal terminal.

5. The pixel driving circuit according to claim 4, wherein the first reset unit includes:

a sixth transistor, a control electrode of the sixth transistor is electrically connected to the reset signal terminal, a first electrode of the sixth transistor is electrically connected to the first voltage signal terminal, and a second electrode of the sixth transistor is electrically connected to the first driving unit; and a seventh transistor, a control electrode of the seventh transistor is electrically connected to the reset signal terminal, a first electrode of the seventh transistor is electrically connected to the initialization signal terminal, and a second electrode of the seventh transistor is electrically connected to the first driving unit.

6. The pixel driving circuit according to claim 2, wherein the driving signal control sub-circuit further includes a driving signal stabilization unit; and the driving signal stabilization unit is electrically connected to the first driving unit, and is configured to stabilize the driving signal generated by the first driving unit.

7. The pixel driving circuit according to claim 6, wherein the driving signal stabilization unit includes a voltage stabilizing storage capacitor;

the first driving unit includes a first storage capacitor and a third transistor, and a first end of the voltage stabilizing storage capacitor is electrically connected to a first end of the first storage capacitor, and a second end of the voltage stabilizing storage capacitor is electrically connected to a second electrode of the third transistor; or a first end of the voltage stabilizing storage capacitor is electrically connected to a second end of the first storage capacitor, and a second end of the voltage stabilizing storage capacitor is electrically connected to a second electrode of the third transistor.

8. The pixel driving circuit according to claim 1, further comprising a third voltage signal terminal, a reset signal terminal and an initialization signal terminal, wherein the driving signal control sub-circuit includes: a first transistor, a second transistor, a third transistor, a fourth transistor, a fifth transistor, a sixth transistor, a seventh transistor, a first storage capacitor and a voltage stabilizing storage capacitor;

a control electrode of the first transistor is electrically connected to the first scanning signal terminal, a first electrode of the first transistor is electrically connected to the first data signal terminal, and a second electrode of the first transistor is electrically connected to a first end of the first storage capacitor;

a control electrode of the second transistor is electrically connected to the first scanning signal terminal, a first electrode of the second transistor is electrically connected to a second electrode of the third transistor, and a second electrode of the second transistor is electrically connected to a second end of the first storage capacitor and a control electrode of the third transistor;

the control electrode of the third transistor is further electrically connected to the second end of the first storage capacitor, a first electrode of the third transistor is electrically connected to the third voltage signal terminal, and the second electrode of the third transistor is further electrically connected to a first electrode of the fifth transistor;

a control electrode of the fourth transistor is electrically connected to the enable signal terminal, a first electrode of the fourth transistor is electrically connected to the first voltage signal terminal, and a second electrode of the fourth transistor is electrically connected to the first end of the first storage capacitor;

a control electrode of the fifth transistor is electrically connected to the enable signal terminal, and a second electrode of the fifth transistor is electrically connected to the driving duration control sub-circuit;

a control electrode of the sixth transistor is electrically connected to the reset signal terminal, a first electrode of the sixth transistor is electrically connected to the first voltage signal terminal, and a second electrode of the sixth transistor is electrically connected to the first end of the first storage capacitor;

a control electrode of the seventh transistor is electrically connected to the reset signal terminal, a first electrode of the seventh transistor is electrically connected to the initialization signal terminal, and a second electrode of the seventh transistor is electrically connected to the second end of the first storage capacitor and the control electrode of the third transistor; and a first end of the voltage stabilizing storage capacitor is electrically connected to the first end of the first storage capacitor, and a second end of the voltage stabilizing storage capacitor is electrically connected to the second electrode of the third transistor; or, a first end of the voltage stabilizing storage capacitor is electrically connected to the second end of the first storage capacitor, and a second end of the voltage stabilizing storage capacitor is electrically connected to the second electrode of the third transistor.

9. The pixel driving circuit according to claim 8, wherein the first transistor, the second transistor, the third transistor, the fourth transistor, the fifth transistor, the sixth transistor, and the seventh transistor are all P-type transistors or all N-type transistors.

10. The pixel driving circuit according to claim 1, wherein the driving duration control sub-circuit includes a second data writing unit, a second control unit and a second driving unit; wherein the second data writing unit is electrically connected to the second scanning signal terminal, the second data signal terminal and the second driving unit, and is configured to write a second data signal having a given working potential received at the second data signal terminal into the second driving unit under the control of the second scanning signal transmitted via the second scanning signal terminal;

the second control unit is electrically connected to the enable signal terminal, the second data signal terminal and the second driving unit, and is configured to transmit a second data signal having a potential changing within a given range received at the second data signal terminal to the second driving unit under the control of the enable signal transmitted via the enable signal terminal;

the second driving unit is further electrically connected to the driving signal control sub-circuit, and is configured to transmit the driving signal to the second control unit and control a duration for transmitting the driving signal to the second control unit according to the second data signal having the given working potential and the second data signal having the potential changing within the given range; and the second control unit is further electrically connected to the element to be driven, and is further configured to transmit the driving signal to the element to be driven.

11. The pixel driving circuit according to claim 10, wherein the second data writing unit includes:

an eighth transistor, a control electrode of the eighth transistor is electrically connected to the second scanning signal terminal, a first electrode of the eighth transistor is electrically connected to the second data signal terminal, and a second electrode of the eighth transistor is electrically connected to the second driving unit;

the second control unit includes:

a ninth transistor, a control electrode of the ninth transistor is electrically connected to the enable signal terminal, a first electrode of the ninth transistor is electrically connected to the second data signal terminal, and a second electrode of the ninth transistor is electrically connected to the second driving unit; and a tenth transistor, a control electrode of the tenth transistor is electrically connected to the enable signal terminal, a first electrode of the tenth transistor is electrically connected to the second driving unit, and a second electrode of the tenth transistor is electrically connected to the element to be driven; and the second driving unit includes:

a second storage capacitor, a first end of the second storage capacitor is electrically connected to the second data writing unit and the second control unit; and an eleventh transistor, a control electrode of the eleventh transistor is electrically connected to a second end of the second storage capacitor, a first electrode of the eleventh transistor is electrically connected to the driving signal control sub-circuit, and a second electrode of the eleventh transistor is electrically connected to the second control unit.

12. The pixel driving circuit according to claim 10, wherein the driving duration control sub-circuit further includes a second reset unit, a reset signal terminal and an initialization signal terminal; and the second reset unit is electrically connected to the reset signal terminal, the initialization signal terminal and the second driving unit, and is configured to reset a voltage of the second driving unit according to an initialization signal received at the initialization signal terminal under control of a reset signal transmitted via the reset signal terminal.

13. The pixel driving circuit according to claim 12, wherein the second reset unit includes:

a twelfth transistor, a control electrode of the twelfth transistor is electrically connected to the reset signal terminal, a first electrode of the twelfth transistor is electrically connected to the initialization signal terminal, and a second electrode of the twelfth transistor is electrically connected to the second driving unit; and a thirteenth transistor, a control electrode of the thirteenth transistor is electrically connected to the reset signal terminal, and a first electrode and a second electrode of the thirteenth transistor are electrically connected to the second driving unit.

14. The pixel driving circuit according to claim 1, further comprising a reset signal terminal and an initialization signal terminal, wherein the driving duration control sub-circuit includes an eighth transistor, a ninth transistor, a tenth transistor, an eleventh transistor, a twelfth transistor, a thirteenth transistor and a second storage capacitor;

a control electrode of the eighth transistor is electrically connected to the second scanning signal terminal, a first electrode of the eighth transistor is electrically connected to the second data signal terminal, and a second electrode of the eighth transistor is electrically connected to a first end of the second storage capacitor;

a control electrode of the ninth transistor is electrically connected to the enable signal terminal, a first electrode of the ninth transistor is electrically connected to the second data signal terminal, and a second electrode of the ninth transistor is electrically connected to the first end of the second storage capacitor;

a control electrode of the tenth transistor is electrically connected to the enable signal terminal, a first electrode of the tenth transistor is electrically connected to a second electrode of the eleventh transistor, and a second electrode of the tenth transistor is electrically connected to the element to be driven;

a control electrode of the eleventh transistor is electrically connected to the second end of the second storage capacitor, a first electrode of the eleventh transistor is electrically connected to the driving signal control sub-circuit and a second electrode of the twelfth transistor, and the second electrode of the eleventh transistor is further electrically connected to a first electrode of the thirteenth transistor;

a control electrode of the twelfth transistor is electrically connected to the reset signal terminal, and a first electrode of the twelfth transistor is electrically connected to the initialization signal terminal; and a control electrode of the thirteenth transistor is electrically connected to the reset signal terminal, and a second electrode of the thirteenth transistor is electrically connected to the second end of the second storage capacitor and the control electrode of the eleventh transistor.

15. The pixel driving circuit according to claim 14, wherein the eighth transistor, the ninth transistor, the tenth transistor, the eleventh transistor, the twelfth transistor and the thirteenth transistors are all P-type transistors or all N-type transistors.

16. A pixel driving method applied to the pixel driving circuit according to claim 1, the pixel driving method comprising a frame period including a scanning stage and a working stage, wherein the scanning stage includes a plurality of row scanning periods, each of the plurality of row scanning periods includes:

writing the first data signal into the driving signal control sub-circuit under the control of the first scanning signal transmitted via the first scanning signal terminal; and writing a second data signal having a given working potential into the driving duration control sub-circuit under the control of the second scanning signal transmitted via the second scanning signal terminal; and the working stage includes:

providing, by the driving signal control sub-circuit, the driving signal to the driving duration control sub-circuit under the control of the enable signal transmitted via the enable signal terminal;

wherein the driving signal is related to the first data signal and the first voltage signal provided via the first voltage signal terminal;

receiving, by the driving duration control sub-circuit, a second data signal having a potential changing within a given range under the control of the enable signal transmitted via the enable signal terminal; and transmitting, by the driving duration control sub-circuit, the driving signal to an element to be driven under the control of the enable signal transmitted via the enable signal terminal;

wherein the duration for transmitting the driving signal to the element to be driven is related to the second data signal having the given working potential and the second data signal having the potential changing within the given range; and an absolute value of the given working potential is related to a working duration of a corresponding element to be driven.

17. The pixel driving method according to claim 16, wherein values of two ends of the given range are a non-working potential and a reference working potential of a second data signal respectively;

an absolute value of the reference working potential is greater than or equal to a maximum value of absolute values of all given working potentials of the second data signal; and the given working potential is within the given range.

18. A display panel, comprising the pixel driving circuit according to claim 1.

19. The display panel according to claim 18, comprising a plurality of sub-pixels, wherein each sub-pixel corresponds to one pixel driving circuit, and the plurality of sub-pixels are arranged in an array of multiple rows and multiple columns;

the display panel further comprises a plurality of first scanning signal lines, a plurality of first data signal lines, a plurality of second scanning signal lines and a plurality of second data signal lines;

pixel driving circuits corresponding to sub-pixels in a same row are electrically connected to a same first scanning signal line and a same second scanning signal line; and pixel driving circuits corresponding to sub-pixels in a same column are electrically connected to a same first data signal line and a same second data signal line; and the display panel further comprise a base substrate on which the pixel driving circuit is disposed, and the base substrate being a glass substrate.

20. A display device, comprising the display panel according to claim 18.

* * * * *